US005640231A

United States Patent [19]

Mitsui et al.

[11] Patent Number: 5,640,231

[45] Date of Patent: Jun. 17, 1997

[54] IMAGE FORMING APPARATUS AND TEMPERATURE CONTROL DEVICE FOR FIXING UNIT FOR USE THEREWITH

[75] Inventors: Teruo Mitsui, Inagi; Kazuki Miyamoto; Naoyuki Ohki, both of Yokohama; Takahiro Ushiro; Masao Watanabe, both of Kawasaki; Atsushi Chaki, Yokohama, all of Japan

[73] Assignee: Canon Kabushiki Kaisha, Tokyo, Japan

[21] Appl. No.: 257,166

[22] Filed: Jun. 9, 1994

[30] Foreign Application Priority Data

Jun. 10, 1993 [JP] Japan ..... 5-138290

[51] Int. Cl.[6] ..... G03G 15/20

[52] U.S. Cl. ..... 399/335; 219/216

[58] Field of Search ..... 355/285, 289, 355/290; 219/216, 470, 469

[56] References Cited

U.S. PATENT DOCUMENTS

| | | | |
|---|---|---|---|
| 4,801,968 | 1/1989 | Kogure et al. | 219/216 X |
| 4,825,242 | 4/1989 | Elter | 219/216 X |
| 4,883,941 | 11/1989 | Martin et al. | 219/216 |
| 4,905,051 | 2/1990 | Satoh et al. | 355/290 |
| 5,083,168 | 1/1992 | Kusaka et al. | 355/285 |
| 5,204,723 | 4/1993 | Hanada et al. | 355/285 |
| 5,241,159 | 8/1993 | Chatteriee et al. | 219/470 |
| 5,302,808 | 4/1994 | Sato et al. | 219/216 |
| 5,343,021 | 8/1994 | Sato et al. | 219/541 |
| 5,361,124 | 11/1994 | Rowe et al. | 355/208 |
| 5,377,321 | 12/1994 | Kaneko et al. . | |
| 5,420,395 | 5/1995 | Hyllberg et al. | 219/470 |
| 5,428,379 | 6/1995 | Kaneko et al. . | |

*Primary Examiner*—William J. Royer

*Attorney, Agent, or Firm*—Fitzpatrick, Cella, Harper & Scinto

[57] ABSTRACT

There is disclosed an image forming apparatus having heating device having a heat generating resistor having a plurality of branches, conduction switching device for switching the conduction at the branch end of the heat generating resistor, and sensing device for sensing the paper size. The switching of conduction of the branch end is performed while not conducting to the heat generating resistor in accordance with the paper size sensed.

29 Claims, 33 Drawing Sheets

| SIZE \ END | T1 | T2 | T3 | T4 | T5 |
|---|---|---|---|---|---|
| A3, A4 | OFF | OFF | ON | OFF | OFF |
| B4, B5 | OFF | OFF | ON | ON | OFF |
| A4R, A5 | OFF | ON | ON | OFF | OFF |
| B5R | OFF | OFF | ON | OFF | ON |
| A5R | ON | OFF | ON | OFF | OFF |
| A5R OR SMALLER | ON | OFF | ON | OFF | OFF |

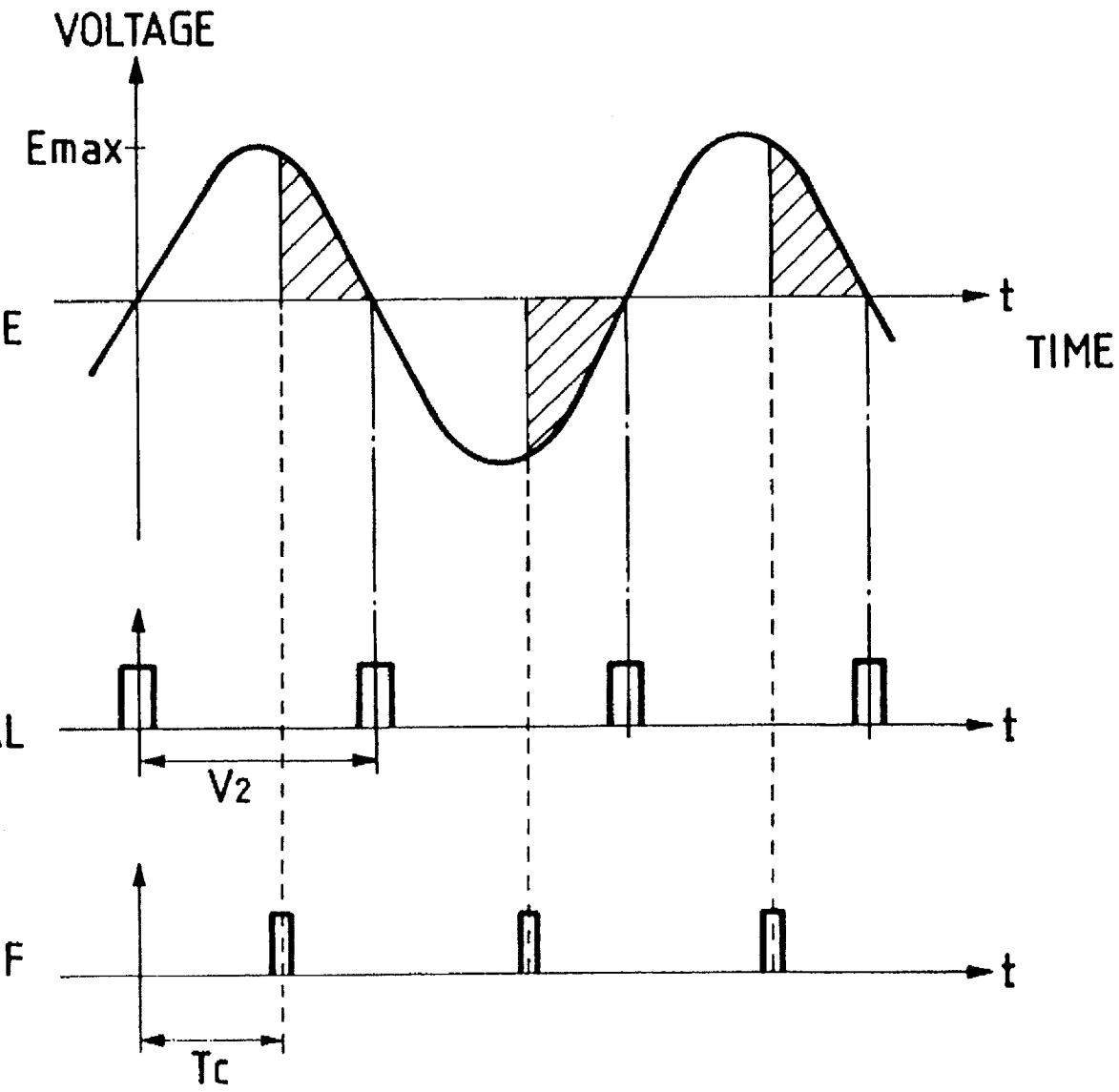
FIG. 4A INPUT VOLTAGE AND LAMP LIGHTNING VOLTAGE
FIG. 4B ZERO CROSS SIGNAL
FIG. 4C TRIGGER SIGNAL OF EXPOSURE LAMP

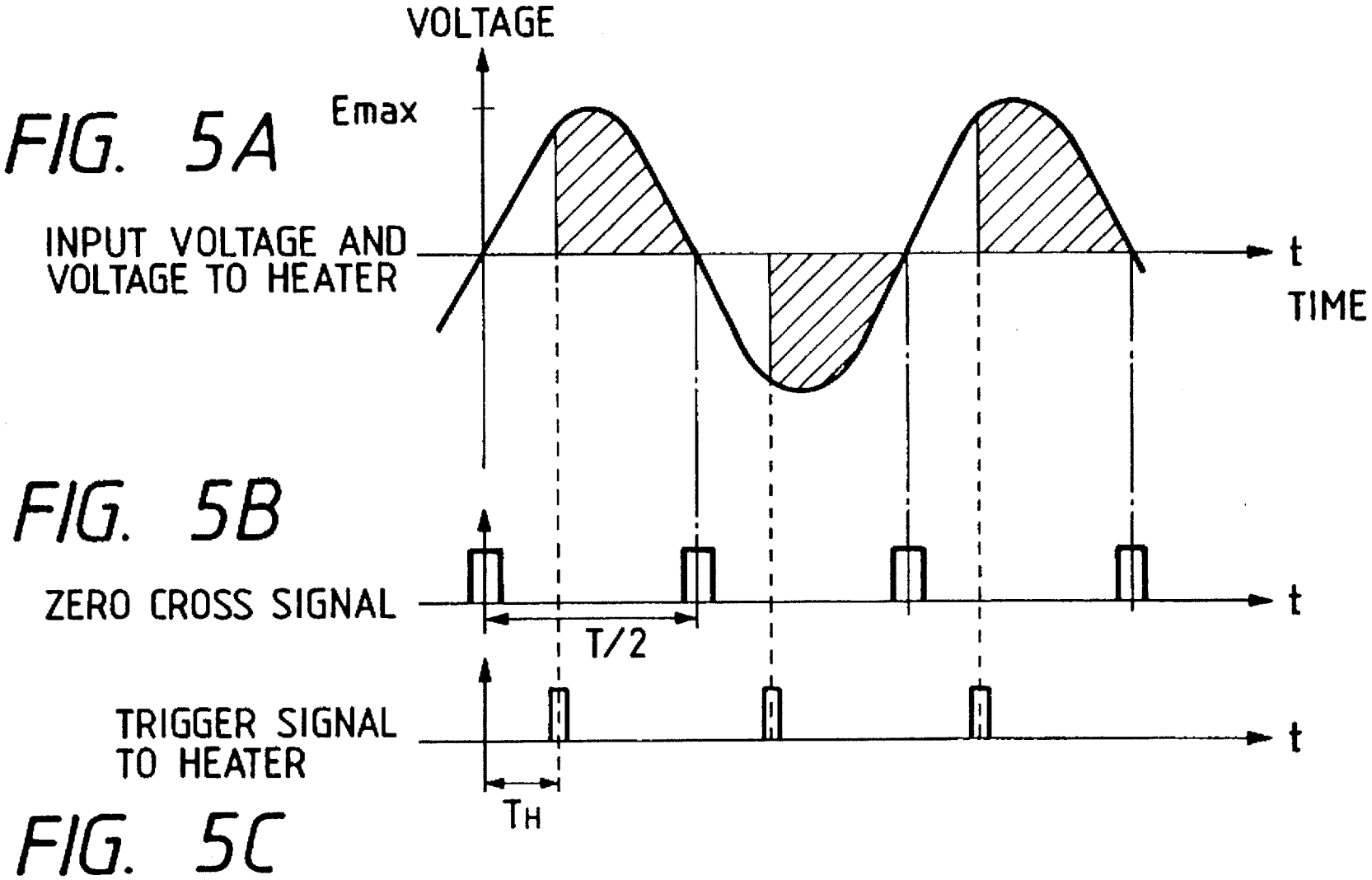
FIG. 5A INPUT VOLTAGE AND VOLTAGE TO HEATER
FIG. 5B ZERO CROSS SIGNAL
FIG. 5C TRIGGER SIGNAL TO HEATER

FIG. 11

| SIZE \ END | T1 | T2 | T3 | T4 | T5 |
|---|---|---|---|---|---|
| A3, A4 | OFF | OFF | ON | OFF | OFF |
| B4, B5 | OFF | OFF | ON | ON | OFF |
| A4R, A5 | OFF | ON | ON | OFF | OFF |
| B5R | OFF | OFF | ON | OFF | ON |
| A5R | ON | OFF | ON | OFF | OFF |
| A5R OR SMALLER | ON | OFF | ON | OFF | OFF |

FIG. 12

[W]

| SHEET SIZE \ TEMPERATURE | $T \leqq T_1$ | $T_1 < T \leqq T_2$ | • • • • • • • • • • • • | $T_n \leqq T$ |
|---|---|---|---|---|
| A3, A4 | $P_{11}$ | $P_{12}$ | • • • • • • • • • • • • | $P_{1n+1}$ |
| B4, B5 | $P_{21}$ | $P_{22}$ | • • • • • • • • • • • • | $P_{2n+1}$ |
| A4R, A5 | $P_{31}$ | $P_{32}$ | • • • • • • • • • • • • | $P_{3n+1}$ |
| B5R | $P_{41}$ | $P_{42}$ | • • • • • • • • • • • • | $P_{4n+1}$ |
| A5R | $P_{51}$ | $P_{52}$ | • • • • • • • • • • • • | $P_{5n+1}$ |
| A5R OR SMALLER | $P_{61}$ | $P_{62}$ | • • • • • • • • • • • • | $P_{nn+1}$ |

VOLTAGE
Emax
INPUT VOLTAGE AND
HEATER SUPPLY VOLTAGE
t

ZERO CROSS SIGNAL
t

H
L
TRIGGER SIGNAL
TO HEATER
t

H
L
CONDUCTING SIGNAL
t

ON
OFF
Tn ON/OFF
REQUEST SIGNAL
t
Δt2
Δt3

H
L
Qn APPLIED SIGNAL
t
t1
t2
t3

HEATER ON/OFF
HEATER ON/LOW WATTAGE t1
t2
HEATER CONDUCTING
ON
OFF
φ1

REGISTRATION ROLLER DRIVE
ON
OFF
φ2

| FIG. 19A |
| --- |
| FIG. 19B |

PHOTOINTERRUPTER 101 OUTPUT φ3

PHOTOINTERRUPTER 102 OUTPUT φ4

LOGIC CIRCUIT OUTPUT φ5
HEATER CONDUCTING OFF OR LOW TEMPERATURE CONTROL
HEATER FIXING TEMPERATURE CONDUCTING

| FIG. 27A | FIG. 27B |
|---|---|

FIG. 29

| ΔW | | T-To | | | | | | |
|---|---|---|---|---|---|---|---|---|
| | | NB | NM | NS | ZR | PS | PM | PB |
| ΔT | NB | PB | PB | PB | PB | PM | PS | ZR |
| | NM | PB | PB | PB | PM | PS | ZR | NS |
| | NS | PB | PB | PM | PS | ZR | NS | NM |
| | ZR | PB | PM | PS | ZR | NS | NM | NB |
| | PS | PM | PS | ZR | NS | NM | NB | NB |
| | PM | PS | ZR | NS | NM | NB | NB | NB |
| | PB | ZR | NS | NM | NB | NB | NB | NB |

IMAGE FORMING APPARATUS AND TEMPERATURE CONTROL DEVICE FOR FIXING UNIT FOR USE THEREWITH

BACKGROUND OF THE INVENTION

1. Field of the Invention

The present invention relates to an image forming apparatus for fixing an unfixed toner image by heating, and a temperature control device for a fixing unit for use therewith.

2. Related Background Art

Conventionally, in the image forming apparatuses using a ceramic heater having branches as heat generating means for fixing, the branches for branched heater were switched in accordance with the used paper size. The switching is performed irrespective of whether the heater is conducting or not.

However, there is a drawback that if the switching of heater branch end is made during conduction, the spark or noise will occur at the switch contact point for switching, adversely affecting an electric circuit.

Also, an image forming apparatus has been heretofore devised in which using pressure transport means (roller) which is driven for rotation while pressing an unfixed toner image on the transfer medium against a heater consisting of a heat generating resistor having a plurality of branches, the toner is fixed onto the transfer medium by placing the transfer medium into close contact with the heater via a film moving at the same speed as a transport rate of the transfer medium. In such apparatus, in a mode in which multiple image forming operations such as a multicopy are consecutively effected by one operation, the fixing heater is controlled at the same temperature until a set number of image forming operations are ended.

Accordingly, there is produced a variation in the temperature distribution of the fixing heater because of the difference between the time for which the transfer medium passes therethrough and the time for which it does not pass, causing a problem that the film may shift due to that variation.

A conventional image forming apparatus for thermally fixing the toner with a ceramic heater having a pattern of heat generating resistor having a plurality of branches involves controlling the temperature with one temperature detecting element placed at a predetermined position. Further, the branching conduction is switched only with the size of used copying paper.

Accordingly, owing to variations in the heat generating resistor pattern (variations in the thickness of pattern or resistor material), the temperature distribution of heat generating resistor is not uniform, in some cases giving rise to a fixing failure or having detrimental effect on the film slippage control.

Also, the conventional temperature control for a so-called roller fixing unit makes the control of applying a maximum electric power until a predetermined temperature is reached, turning off the conduction to heater upon detecting the predetermined temperature or greater, and supplying again the maximum electric power below the predetermined temperature.

In the case of roller fixing, such control was sufficiently practical because of a great heat capacity of the heat roller, but there is a problem that when the temperature of fixing unit is low, the fixing can not be effected immediately after conducting, and in the light of such characteristic, the usage of fixing unit to make the temperature control of fixing unit at any time, irrespective of whether the fixing operation is performed, has been widely made, presenting several problems broadly from the aspects of economy and ecology.

On the other hand, among the fixing units as above described, there is developed a fixing unit comprising a member moving along with a thin film belt (film) of great heat conductivity and a heater of small heat capacity. Such fixing unit can effect the temperature control in the range from a sufficiently low temperature to a fixing temperature in a short fast copy time. Herein, when the temperature control of heater is made, it is necessary to suppress the ripple (overshoot) in raising the temperature of heater up to a predetermined temperature. Thus, conventionally, the application power (voltage) is controlled depending on the difference between the temperature detected by a temperature detection element attached on the heater portion and a predetermined temperature.

However, there is a problem that only by making such control that the application power (voltage) is changed depending on the temperature detected by the temperature detection element attached on the heater portion, the overshoot may be reduced, but because this control does not take into consideration other factors different than the heater temperature, the first transfer sheet after starting conduction may have poor fixing ability, principally due to the nature that the heat capacity of heater is small.

On the contrary, to improve the fixing ability, if the electric power applied to the heater is increased, there is the disadvantage that the overshoot may be larger, but the heater of small heat capacity mainly made of ceramic is damaged, resulting in a shorter life and less durability of an apparatus.

Further, it has been found that because the temperature control is not well performed, the transfer sheet undergoing fixing may curl up, albeit excellent fixing ability and durability, causing a jam.

Also, the factors involved in the fixing ability and durability include the heater temperature, the pressure roller temperature, the responsibility of temperature sensor for the heater, the size of copying paper, the thickness of copying paper, the quality of material, the outside air temperature, the humidity, and the service condition of the main body in the past, but if these factors are adapted for the control to solve the above problems relating to the fixing ability and the durability, there is the drawback that the number of parameters will increase, and the relation between all the parameters and the amount of control is difficult to formulate.

That is, where the number of parameters (status amounts) is increased to determine the control amount for the heater electric power in attempting the optimal power control for the heater, or where there exists any parameter which has ambiguous relation with the control amount among the parameters, the relation between the parameters and the control amount is difficult to formulate.

SUMMARY OF THE INVENTION

Therefore, it is a first object of the present invention to provide an image forming apparatus which has reduced sparks at the contact point caused by switching the conduction of a fixing heater.

To achieve the first object of the present invention, there is provided an image forming apparatus comprising heating means composed of a heat generating resistor having a plurality of branches, conduction switching means for switching the conduction at the branch end of the heat generating resistor, control means for controlling the voltage across the heat generating resistor, and sensing means for sensing the used paper size, wherein the switching of the conduction at the branch end is performed while not conducting to the heat generating resistor in accordance with the paper size sensed.

According to the present invention, by switching the conduction at the branch end of heater while not conducting to the heater, sparks at the contact point of a switch can be reduced, thus relieving the adverse effect on the electric circuit.

Also, it is a second object of the present invention to provide an image forming apparatus having a fixing unit for fixing an unfixed toner image on a transfer medium to the transfer medium by placing the transfer medium into close contact with a heater composed of a heat generating resistor having a plurality of branches, using pressure transport means which is driven for rotation while pressing the transfer medium against the heater, via a film moving at the same speed as the transport rate of the transfer medium, wherein the film movement amount can be reduced by eliminating the variation in temperature distribution of a fixing heater when forming the continuous image.

To accomplish the second object, there is provided control means for controlling the temperature of the heater depending on whether the state where the transfer medium passes over the heater or the other state when in the continuous copying.

Also, according to a preferred embodiment of the present invention, there is provided drive means for driving feeding means for feeding the transfer medium, wherein the timing of supplying an electric power for application to the heater serving for closer contact of an unfixed toner with the transfer medium based on a signal of driving the drive means is determined.

With the above means, the movement of the film when forming the continuous image can be reduced.

Also, it is a third object of the present invention to provide an image forming apparatus wherein the fixing ability is stabilized, without depending upon the dispersion in the temperature distribution of the heat generating resistor, and the film slippage control is stabilized.

To achieve the third object of the present invention, there is provided an image forming apparatus comprising control means for controlling the voltage across the heat generating resistor, a plurality of temperature detection means for detecting the temperature of the heat generating means, and sensing means for sensing the used paper size, wherein the conduction to the branch end is effected in accordance with the paper size sensed by the sensing means, and the temperature control of the heat generating resistor is performed by temperature detection means indicating the lowest value among the temperature detection means in the passing paper portion.

According to the preferred embodiment of the present invention, if there is a portion of which the temperature is equal to or greater than a specified value in the passing paper portion, the branch conduction which has been performed in accordance with the size of copying paper until that time is switched to that in which the temperature of the portion equal to or greater than the specified value is lowered.

With the present invention as above described, it is possible to stabilize the fixing ability which may be degraded due to the dispersion in the temperature distribution of the heat generating resistor and the film slippage control. Also, it is permitted to have some dispersion in the heater manufacturing process, so that the yield in the manufacturing of heater can be raised.

It is a fourth object of the present invention to provide an image forming apparatus comprising heating means having a heat generating resistor, a thin film belt moving along with a recording medium, and a fixing unit in which a toner image on the recording medium is heated via the thin film belt by heat from the heating means, wherein the suitable heater electric power control is enabled based on various parameters, and the fixing ability and the durability are consistently effected.

To achieve the fourth object of the present invention, the fixing unit comprises status amount sensing means for sensing or inputting the status amount concerning the control of electric power to be supplied to the heating means, rule means for regulating the relation between the status amount and the operation amount in performing the electric power control to the heating means, as a qualitative rule, and inference means for inferring the operation amount in accordance with a rule output from the rule means, and based on the degree to which the status amount belongs to a predetermined set.

According to the preferred embodiment of the present invention, the fixing unit comprises status amount sensing means for sensing or inputting the status amount relating to the control of electric power to be supplied to the heating means, status amount calculating means for calculating a new status amount from the status amount, membership function storing means for storing the membership function representing said status amount and the operation amount in fuzzy sets, respectively, rule storing means for storing the rule representing the status amount and the operation amount in the form of fuzzy proposition, adaptation calculating means for calculating the adaptation of status amount sensed by the status amount sensing means, based on the membership function of status amount stored in the membership function storing means, arithmetic operation means for obtaining an inferred result of each rule stored in the rule storing means, through a predetermined arithmetic operation, based on the adaptation calculated by the adaptation calculating means, calculating means for calculating the operation amount based on the inferred result of each rule obtained by the arithmetic operation means, and control means for controlling the operation amount of a supply electric power control system based on the operation amount calculated by the calculating means.

According to the present invention, there is provided means for directly sensing at least one of the heater temperature, the temperature of pressure roller, the size of copying paper, the thickness of copying paper, the quality of material, the outer air temperature, and the humidity, with which the electric power applied to the heater is placed under the fuzzy control to maintain the fixing ability.

That is, in controlling the heater electric power, there are too many parameters (status amounts) for the control the heater electric power of the copying machine, in which when the relation between all the parameters and the control amount is difficult to formulate, or when the relation between the parameters and the control amount is ambiguous, such ambiguous relation is fuzzy inferred to determine the control amount.

BRIEF DESCRIPTION OF THE DRAWINGS

FIG. 4A to 4C are graphs representing the lighting timing of an exposure lamp.

FIG. 5A to 5C are graphs representing the drive timing of a fixing heater.

FIG. 11 is a table showing the on/off of the heater branch end in accordance with the paper size.

FIG. 12 is a table showing the electric power in accordance with the temperature and the copying paper size.

FIGS. 28A-1 and 28B-7 are graphs representing the membership function in an example 5 and graphs representing the membership function for $(T-T_0)$ in FIG. 28A-1.

FIG. 29 is a table showing the fuzzy rules in the example 5.

DETAILED DESCRIPTION OF THE PREFERRED EMBODIMENT

The preferred embodiments of the present invention will be described below in detail with reference to the accompanying drawings.

EXAMPLE 1

Figure 1:
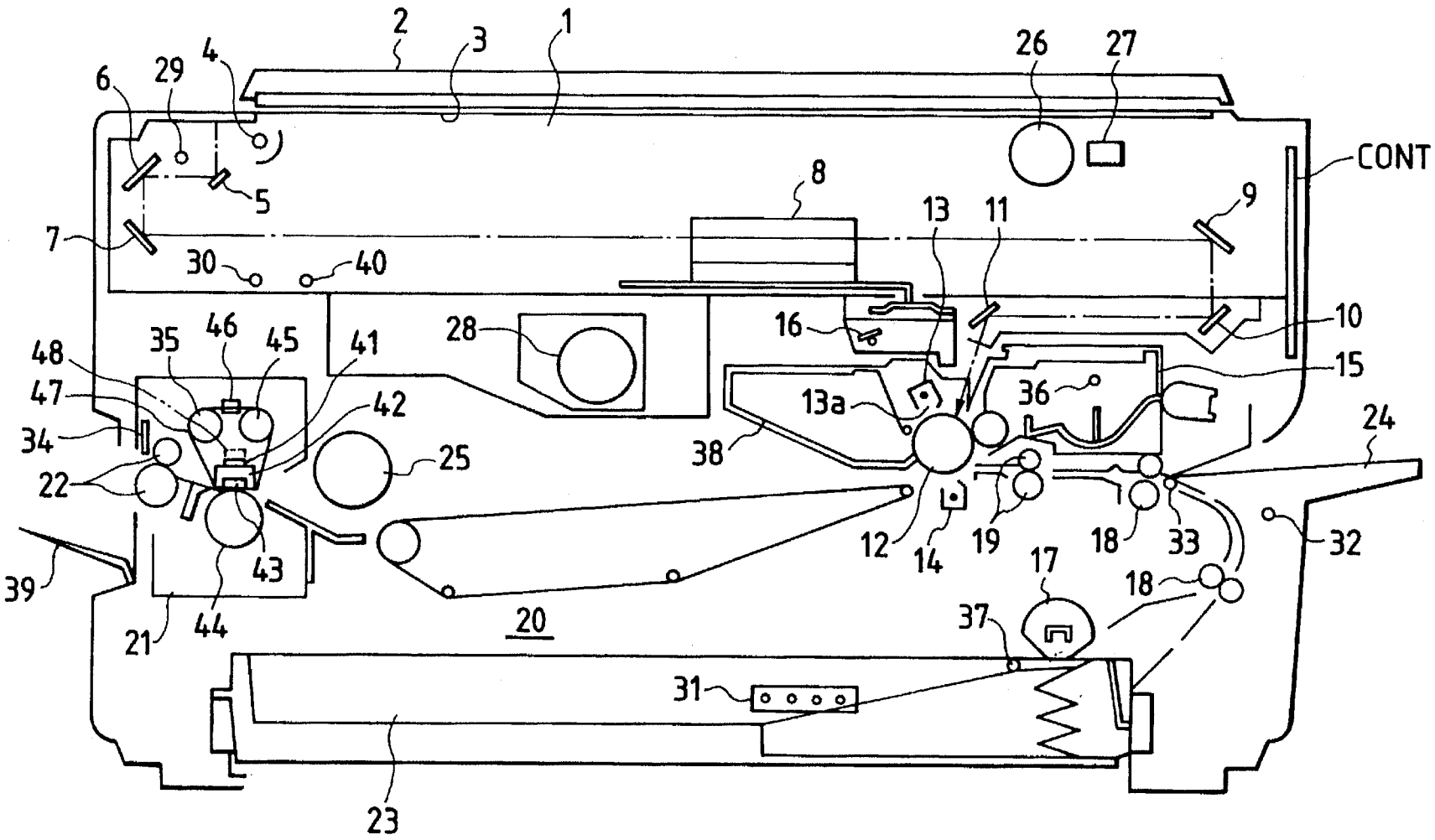
FIG. 1 is a cross-sectional constitutional view of an image forming apparatus in an example of the present invention.

FIG. 1 is a cross-sectional constitutional view of an image forming apparatus in this example of the present invention. In this figure, a drive system is divided into a main drive system for driving a paper feeding portion, a transport portion, a photosensitive body and a fixing portion, and an optical drive system for driving an optical system which becomes a load. A main drive source uses an AC synchronous motor 25, and an optical drive source (including a mechanism for reading the image) uses a stepping motor (PM) 26. CONT is a controller portion, which has a microcomputer Q1 and a drive circuit comprising an extension IC Q2 as will be described later.

It should be noted that if an excitation drive system is optionally designated by the extension IC Q2 of the microcomputer Q1, a phase exciting signal for the application to each phase A, A*, B, B* (* indicating a reverse signal) of the stepping motor PM is output. In this example, the excitation drive system switches the stepping motor PM into either of two types of a two-phase excitation system and a 1-2-phase excitation system, depending on the speed information to be set in the load.

For the supply of papers, either of two paper supply systems from a cassette 23 and through a multi manual inserter 24 can be selected. In the case of supplying the paper from the cassette 23, the condition is administered using a switch for sensing the presence or absence of the cassette 23, a group of switches 31 for sensing the size of papers contained within the cassette 23, and a switch 37 for sensing the presence or absence of paper within the cassette 23, whereby if the abnormality is detected by the above switches, it is displayed on an indicator as will be described later.

In the case of the multi manual insertion, the condition is administered by a switch 32 for sensing the state of a manual inserter 24, whereby if the abnormality is detected, it is displayed on an indicator as will be described later.

The photosensitive body 12 is rotated in a clockwise direction as seen in the figure. The potential electrified on the photosensitive body 12 by a primary electrifier 13 is sensitized at a photosensitive position as will be detailed later, and developed by a developing unit 15 to allow a transfer unit 14 to transfer an image onto a transfer sheet supplied from the paper supply portion. The photosensitive body after transferring is cleaned off by a cleaning unit 38 to remove residual toner, and the residual potential is removed by a pre-exposure lamp 16, whereafter the process of making the image formation is repeated again.

The transfer sheet having the image transferred thereto is fed on a transport belt in the transport unit 20 to a fixing unit 21. The fixing unit 21 is comprised of three rollers including a drive roller 35, a tension roller 45 and a pressure roller 44. A heater 43 has a resistor printed on a ceramic substrate, and is supported on a heat resistant plastic supporter 42. Further, the plastic supporter 42 has a metallic stay attached thereto for the reinforcement.

Also, an endless film 47 is looped around the drive roller 35, the tension roller 45, and the heater 43. A temperature detection element (thermistor) 41 is attached to the metallic stay, and is directly contacted with the back face of the heater 43. Another temperature detection element 48 is also attached to the metallic stay, like the temperature detection element 41. A heater unit comprised of the heater 43, the plastic supporter 42 and the metallic stay, and the endless film 47 press on the pressure roller 44.

A sheet passing through the fixing unit 21 is exhausted out of the fixing unit 21 by a paper exhausting roller 22 and received into a paper exhausting tray 39.

A paper exhausting sensor 34 senses whether or not the transfer sheet has normally passed through the fixing unit 21.

Figure 9:
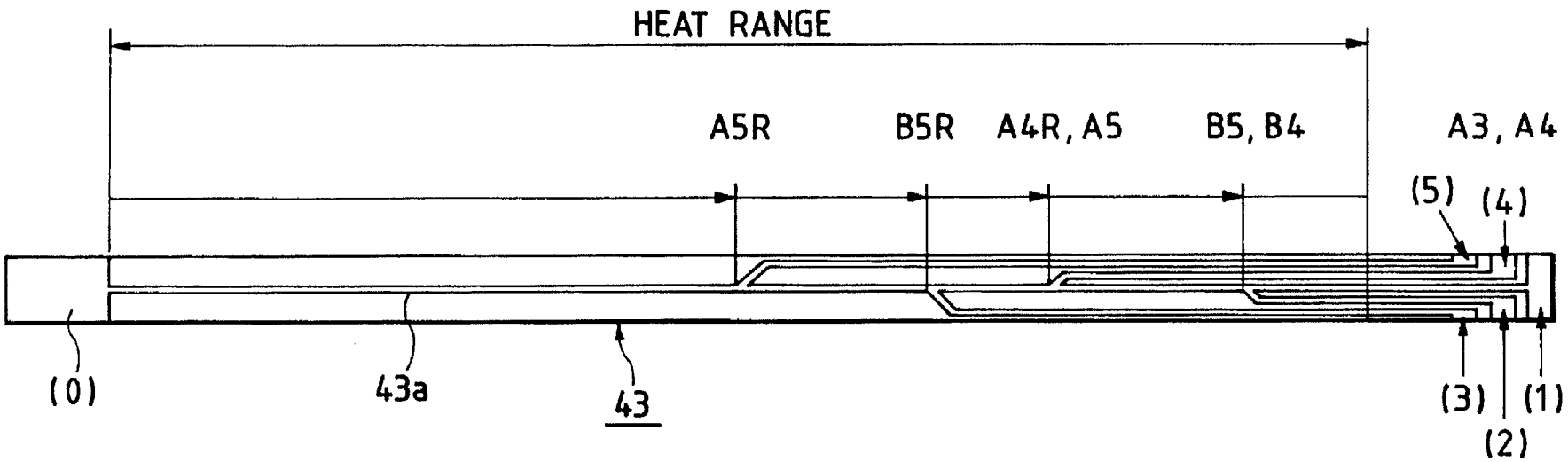
FIG. 9 is a view showing a heater plane of a branched heater.

FIG. 9 shows an external view of a ceramic heater. As will be seen from this figure, this heater has a plurality of branches. The branch position corresponds to any one of B4, A4R, B5R and A5R, depending on the paper size. If the size is found by a cassette size detector 31, the heater branch is switched in accordance with the size.

The drive source for the optical drive system is a stepping motor 26 as previously described. This drive source will be described later in FIG. 6, but the stepping motor 26 is configured to drive entirely different loads by the operation of a drive switching solenoid 27. One load is a unit constituting an exposure lamp 4, a first mirror 5, a second mirror 6, and a third mirror 7, and another load is a unit constituting a zoom lens 8. These loads which need not be driven in synchronism can be driven by a common drive source.

This apparatus has, through the use of the stepping motor 26 in the optical drive unit, a multi-stage magnification selection function under the positional control of the zoom lens 8 and the speed control of a lamp system 4 to 7, an automatic density selection function for automatically selecting the density by a photosensor 40 capable of sensing the reflected light from the original placed on the plane of an original glass 3, an automatic copying magnification selection function (having communication means) by the connection to an external equipment (not shown), a memory backup function for storing various statuses, upon detecting an abnormal condition such as a paper jam, including the number of residual sheets, the magnification value and the abnormal information, a page continuous copying function for controlling the position of the exposure lamp 4 by means of the stepping motor 26, and a control switching function for switching the control based on the state of a switch 36 for sensing that the developing unit 15 is exchanged, wherein a plurality of color images can be formed by exchanging the developing unit 15.

The operation of this apparatus will be described below.

Figure 2:
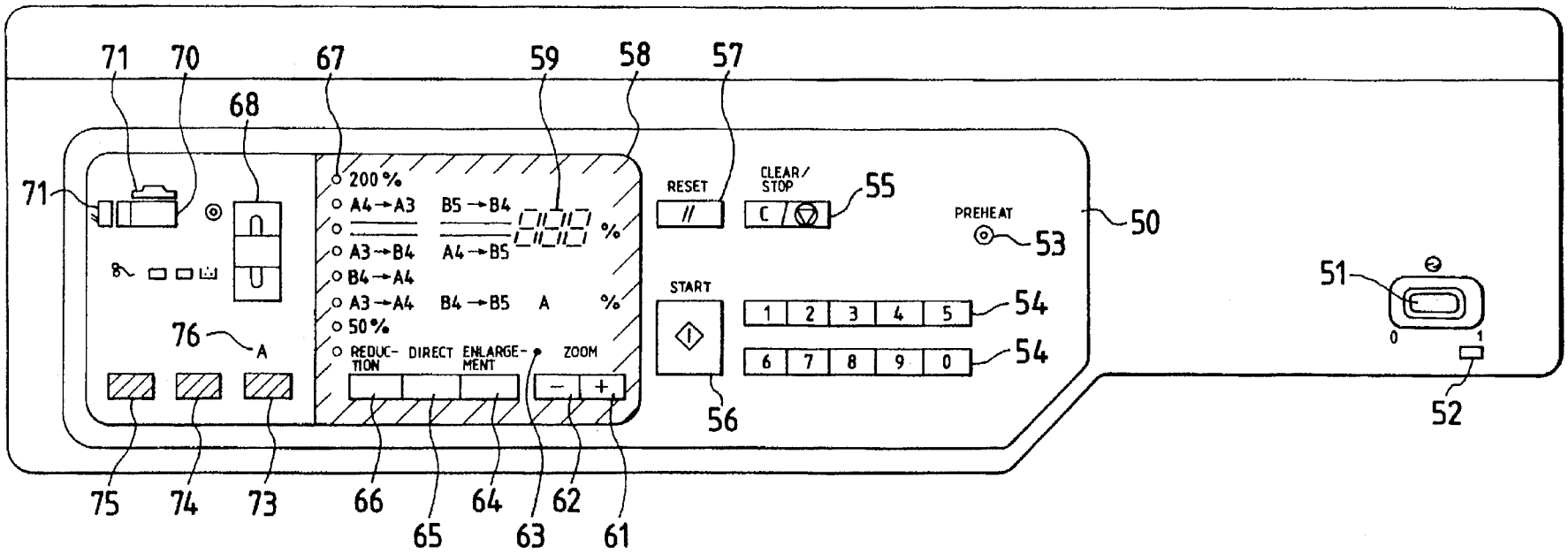
FIG. 2 is a view showing an operation panel of this example.

An electric cord (not shown) of this apparatus is connected to a predetermined electric power source. FIG. 2 is an operation panel of this apparatus which is arranged on the upper plane of FIG. 1. Upon depressing the "1" side of a power switch 51, the electric power is supplied to this apparatus, while a power indication lamp 52 is lighted up.

When the power is turned on, the operation panel is set as a standard mode; a sheet number indicator 59 indicates 1, a magnification indicator 67 indicates direct, and an automatic density adjustment indicator 76 is lighted at A.

A start key 56 is indicated red during the initial setting when the power is turned on (for moving the lens to the direct position) and during the copying operation, and is normally indicated green to indicate that the copying operation is ready.

It should be noted that the warm tone temperature of the fixing unit 21 is different with the type of the developing unit 15, and can be switched by discriminating the type of developing unit 15 using the switch 36 provided on the developing unit 15.

Next, the operation of the optical drive system after turning on the power will be described. The exposure lamp system 4 to 7 is moved to scan the original on the original glass 3 from the left end to the right in FIG. 1, to effect the exposure of the original image to the photosensitive body 12 via a first mirror 5, a second mirror 6, a third mirror 7, a zoom lens 8, a fourth mirror 9, a fifth mirror 10, and a sixth mirror 11. That is, the start point of movement is set to the leftmost end. This position is referred to as a home position (H.P.). An H.P. sensor 29 is provided to detect H.P.

Figures 3, 3A:
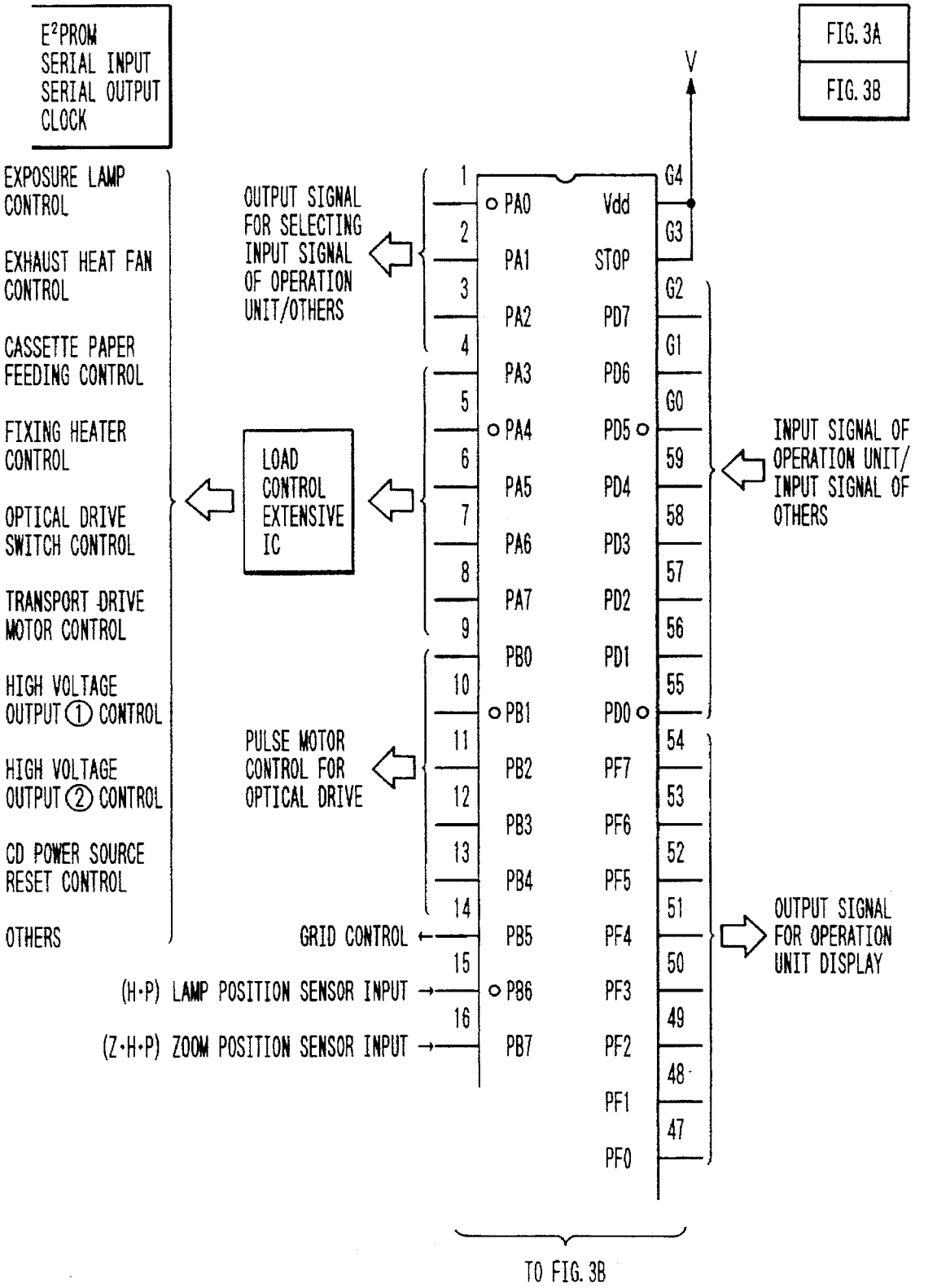
FIG. 3 which is comprised of FIGS. 3A and 3B is a configuration diagram of a microcomputer for the control in this example.
Figure 3B:
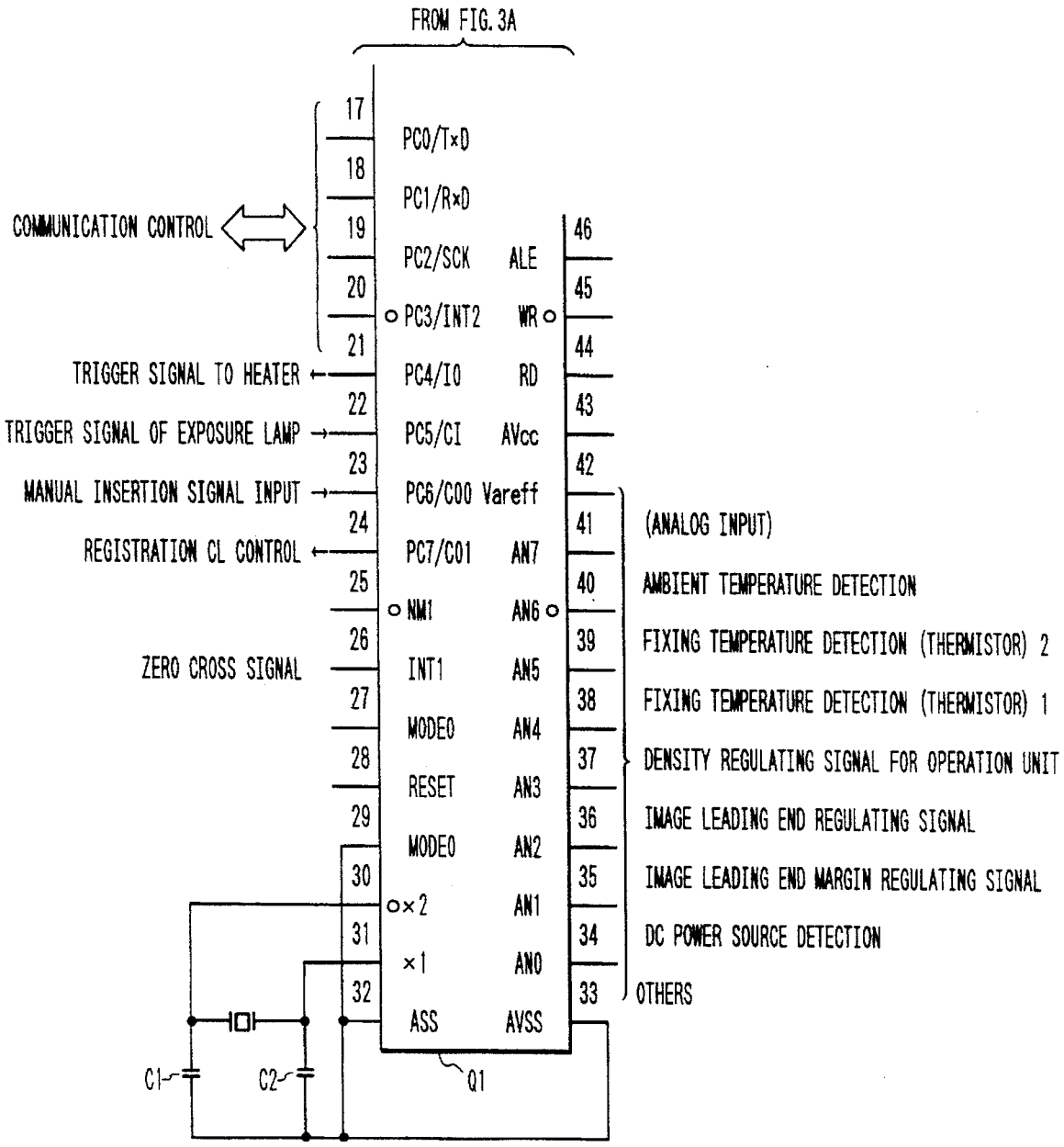

If the H.P. sensor does not detect the position of the exposure lamp 4 when the power is turned on, the control unit of a one-chip microcomputer as shown in FIGS. 3A and 3B controls the rotation of the stepping motor 26 to move the exposure lamp unit to the H.P. side.

The start of the rotation control will be described in connection with FIG. 6. First, when the drive switching solenoid 27 is off (without any force exerted in a direction toward b'), a switching gear (3) is moved in a direction of A by a spring force. Thereby, the output of the stepping motor 26 is connected via the switching gear (3) to a lamp driving gear (1) to drive the exposure lamp unit 4 to 7. In connecting the gears, when the switching gear (3) and the lamp driving gear (1) are engaged together, the stepping motor 26 is controlled to sufficiently decrease the number of rotations thereof.

Where the exposure lamp unit 4 to 7 is positioned at H.P., the stepping motor 26 moves the zoom lens unit 8. As previously described, when the power is turned on, a direct magnification value is selected as the standard mode. Also, since the zoom lens home position (Z.H.P.) has been set at a direct magnification position, it is unknown on which side the position of the zoom lens 8 is located with respect to Z.H.P., when the power is turned on. Hence, a non-volatile memory is provided to store on which side the position of the zoom lens 8 is located with respect to the Z.H.P., before turning off the power.

Figure 6:
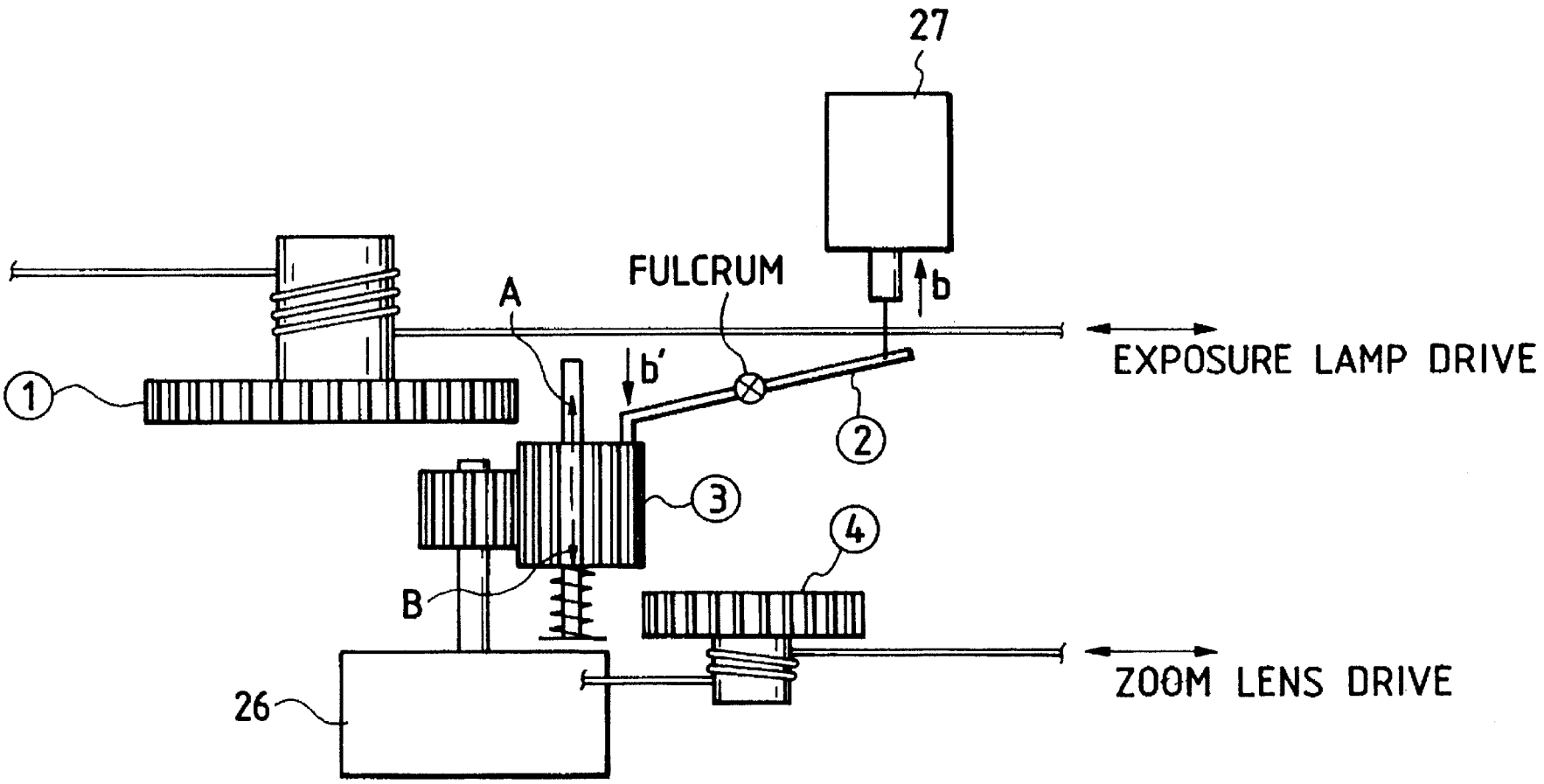
FIG. 6 is a view showing the constitution of an image exposure system.

Referring to FIG. 6, the operation thereof will be described below. First, the drive switching solenoid 27 is turned on. Thereby, a plunger of the solenoid is moved in a direction of b. Hence, owing to the force in a direction of b', the switching gear (3) is moved in a direction of B against the spring force. By this movement, the switching gear (3) and the lamp drive gear (1) are disengaged. By a further movement in the direction of B, the switching gear (3) is engaged with the lens drive gear (4). The control for rotation when the gears are engaged is similar to that as previously described.

The zoom lens 8 is direct if the lens position is at the position of Z.H.P. sensor, enlargement if it is located on the optical system H.P. side from Z.H.P. with the Z.H.P. sensor as the reference position, or reduction if it is located on the converse side. The positional control can be made within a scope from an enlargement ratio of 200% to a reduction ratio of 50%.

When the driving of the zoom lens is started, the operation is classified as follows, depending on the Z.H.P. status.

1) Where the position of zoom lens 8 is sensed by the Z.H.P. sensor.

The zoom lens 8 is once moved to the optical system H.P. side out of the sensing range of the Z.H.P. sensor and stopped.

It is moved to the right side a predetermined distance since the time when the Z.H.P. sensor has sensed, and stopped.

2) Where the position of zoom lens 8 is not sensed by the Z.H.P. sensor.

The moving direction of the zoom lens (to the Z.H.P. sensor side) is determined by the position of the zoom lens 8 stored in the non-volatile memory, and then the zoom lens is moved.

When moved to the right side.

The zoom lens 8 is moved a predetermined distance since the time when the Z.H.P. sensor has sensed, and then stopped.

When moved to the left side.

The zoom lens 8 is once moved to the optical system H.P. side out of the sensing range of the Z.H.P. sensor and stopped.

It is moved to the right side a predetermined distance since the time when the Z.H.P. sensor has sensed, and stopped.

The above operation is a requisite control for preventing the setting positional error from occurring due to backlash of the gears.

Thereafter, the drive switching solenoid 27 is turned off. By this action, the switching gear (3) is moved in a direction to be engaged with the lamp drive gear (1), as previously described. However, for the smooth engagement, it is required to rotate the switching gear (3), as previously described. At this time, the exposure lamp unit 4 to 7 is located at the H.P. 29.

Thus, the stepping motor 26 rotates the exposure lamp unit 4 to 7 in a direction of movement to the right. As a result, it stops rotating at the time when the exposure lamp unit 4 to 7 comes out of the range of the H.P. sensor 29 (the engagement between the switching gear (3) and the lamp drive gear (1) is released), and rotates the exposure lamp unit 4 to 7 again in a reverse direction to stop at a predetermined position after sensing of the H.P. sensor 29.

Upon termination of the initial operation of the optical drive system as above described, the preparation for the copying operation of this apparatus is completed.

Next, the copying operation with the paper supply from the cassette 23 will be described below.

Upon depressing a copy start key 56, the copying operation is started, based on the transfer sheet size data by the input signal of a switch group 31 for sensing the cassette size, the sheet number data set by a sheet number key 54, the magnification data by magnification selection keys 61, 62, 64, 65, 66, and the data by a variety of other mode selection means.

If the copy start key 56 is accepted, the indicator is changed from green to red, and the mode switching keys such as the sheet number key 54, and the magnification keys 61, 62, 64, 65, 66 are disenabled for the input. The main drive motor 25 starts rotating to transmit a driving force to the paper feed roller 18, the photosensitive body 12, the transport unit 20, the fixing unit 21 and the like.

After 0.5 sec., since the start of rotation of the main drive motor 25, the paper feed solenoid (not shown) is activated, whereupon the paper supply roller 17 is rotated to feed a transfer sheet within the cassette 23 in a direction of the paper feed roller 18. The amount of feeding the transfer sheet by the paper supply roller 17 is controlled by the size of cassette data. That is, when the transfer sheet is greater than a predetermined value, the feeding amount is increased. If the transfer sheet reaches the paper feed roller 18, the transfer sheet is fed to a registration roller 19 by this paper feed roller 18, at which time it is stopped. A manual insertion switch 33 between the paper feed roller 18 and the registration roller 19 is used to sense the state of feeding the transfer sheet.

At a predetermined timing before the time when the transfer sheet fed on the paper feed path reaches the registration roller 19, the original scan start by the exposure lamp unit 4 to 7 is permitted. At this time, the exposure lamp is located at a site where it is sensed by the H.P. sensor 29. More particularly, it is stopped at a site backward a distance corresponding to a selected magnification for that time from the position of sensing the H.P. sensor on the backward movement of the initial operation or the copying operation.

Upon the start of original scan, a pulse motor 26 which is a drive source for the optical system rotates in a direction in which the exposure unit 4 to 7 advances (in the right direction) and progressively increases its pulse rate (referred to as the slow up control) until the drive pulse rate corresponding to a selected magnification value is reached. That is, the moving speed is gradually accelerated up to the target speed. A pulse motor drive circuit of this apparatus, specifically not shown, employs a constant current control method and takes a configuration where the drive current value can be switched at multiple steps (two steps in this example) (this value is selected by a PB4 output signal among the optical driving pulse motor control signals as shown in FIGS. 3A and 3B).

Typically, in the pulse motor characteristics, the pull-in torque decreases with higher pulse rate. Therefore, means for switching the constant current set value is provided to switch the current value as necessary.

In this apparatus, the set current is controlled in such a way that its value is lower from the start of movement up to the relatively low pulse rate, raised from the time at which the speed is beyond a predetermined value, and lowered again with the elapse of a predetermined time after reaching the target speed. This is mainly aimed to avoid the noise of pulse motor, the temperature elevation and the step-out phenomenon.

Figure 7:
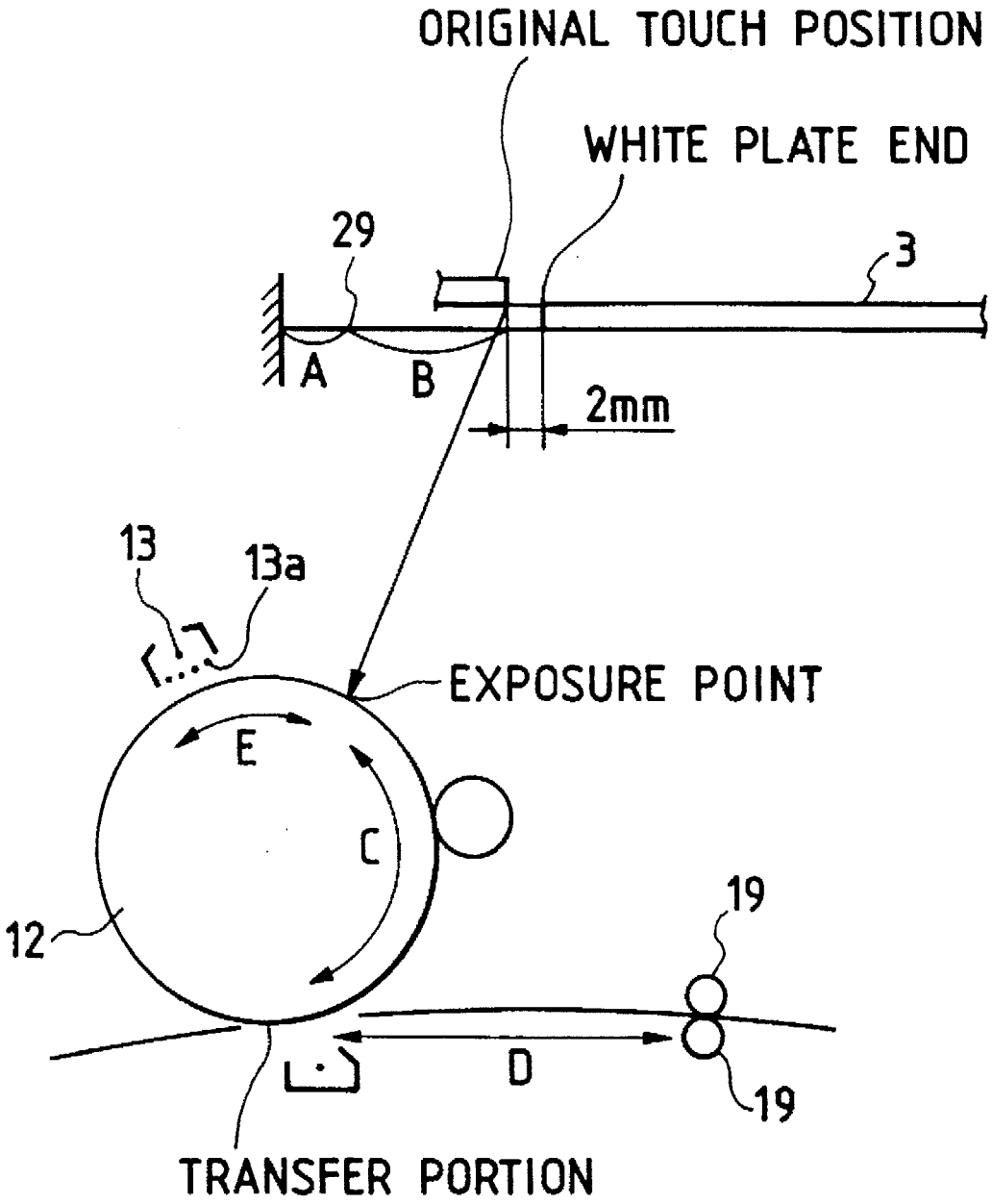
FIG. 7 is a view showing a margin forming method of the image leading end portion.

Referring now to FIG. 7, a margin forming method for the image leading end and a leading end aligning method of the transfer sheet will be described below.

As means for preventing the sticking of the toner to the non-image area, static eliminator means by a light source such as an LED lamp and a fuse lamp is typically employed, but in this example, the same effect can be achieved by controlling the voltage value of a grid 13*a* provided on a primary electrifier unit 13 of this apparatus. This is an important method in the state of the art because a plurality of members are difficult to dispose around the photosensitive body owing to the reduction in size of apparatus.

Since the distance E from the exposure point to the grid can not be significantly shorter than the distance B between the H.P. sensor 29 and the original touch position, to form a leading margin of 2 mm for the original, the grid is switched from the L level to a predetermined voltage in a predetermined time corresponding to the selected magnification value from the start of movement of the exposure lamp 4. That is, when the grid voltage is at the L level, the toner image is not formed because the potential is not electrified on the photosensitive body, whereby the image is formed from the timing of switching to the above predetermined voltage to form a margin in the image leading end portion.

For the alignment of the leading end of image with the transfer sheet, the distance C between the exposure point and the transfer portion is made shorter than the distance D between the registration controller 19 and the transfer portion. For this purpose, before the image on the leading end of original is actually exposed on the photosensitive body 12, it is necessary to feed again the transfer sheet waiting in the region of the registration roller 19 as above in a direction toward the transfer unit.

In this apparatus, when the exposure lamp 4 starts moving to reach the target speed, it is still sensed by the H.P. sensor 29. The distance B value since the timing of passing through the H.P. sensor 29 plus 2 mm divided by the speed corresponding to the selected magnification is the time required for the exposure lamp 4 to reach a white plate end after passing through the H.P. sensor 29, and this time is denoted as x.

Also, the value of the time for the transfer sheet to reach the transfer unit since the start of refeeding the paper by the registration roller 19, subtracted by the time required for the image at the exposure point on the photosensitive body 12 to reach the transfer unit, is denoted as y, and the time required to transfer the transfer sheet 2 mm is added to y (2 mm/100 mm/s=0.02 sec . . . transport speed=100 mm/s). The above numeric values are computed by the following expression.

$$x-(y+0.02)=Z(\text{sec}) \tag{1}$$

That is, if the registration roller 19 is activated at the timing after the elapse of a value Z as above by an image leading signal which is output upon passing the H.P. sensor 29 to feed the paper again, the transfer sheet image can be obtained with a margin of 2 mm formed corresponding to the selected magnification. Note that this image signal is also used for the control of the heater in the second example as will be described later.

The exposure unit 4 to 7 is moved for scanning a predetermined distance in accordance with the cassette size data and the magnification data, and upon reaching the target position, the pulse rate is gradually decreased (which is referred to as the slow down control), and stopped. Thereafter, the exposure unit is moved backward under the slow up control and the slow speed control in a direction toward the H.P. sensor 29. And when sensing the H.P. sensor 29, the slow down control is effected to stop the exposure unit at the position corresponding to the selected magnification, so that the exposure unit 4 to 7 is stopped.

Figure 8:
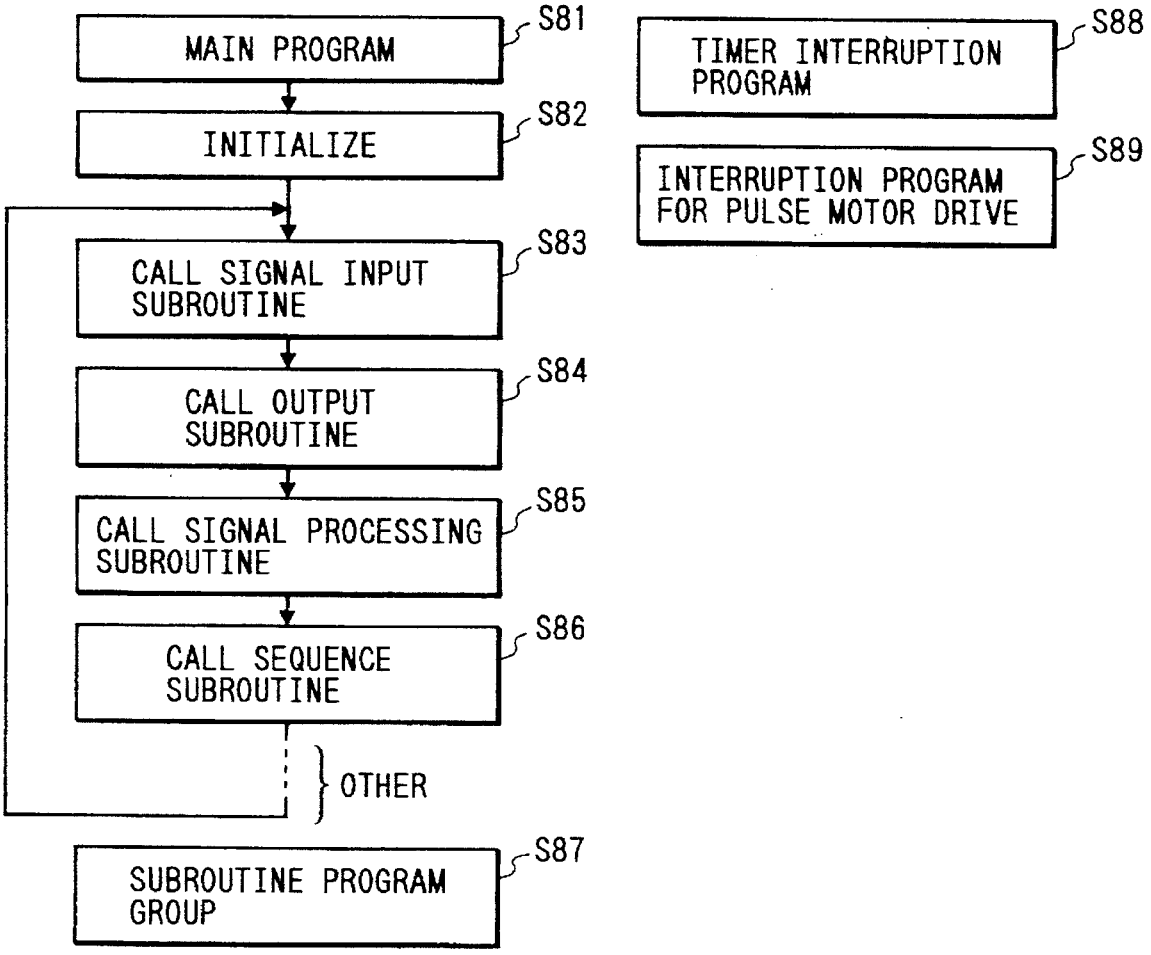
FIG. 8 is a flowchart showing the basic operation of the microcomputer as shown in FIGS. 3A and 3B.

The control for the original scanning distance is executed by a trailing end signal of the transfer sheet. The control operation as above described is performed by a one-chip microcomputer. $Q_1$ in FIGS. 3A and 3B indicates a one-chip microcomputer containing ROM and RAM. FIG. 8 is a basic configuration of this microcomputer. Note that S87 is a subroutine program group called by S83 to S86, and S88, S89 is an interrupt program called during the execution.

Referring to FIGS. 4A to 4C, the control for the exposure lamp will be described below. The exposure lamp uses a halogen lamp, wherein the AC power source is phase controlled so that the lighting voltage of the halogen lamp may be constant (lamp regulator, not shown). This lamp regulator controls the lamp lighting voltage Vc to be constant even if the AC input voltage or the power supply frequency varies. Thus, a trigger signal of the exposure lamp for the phase control is output from this lamp regulator into the controller. The trigger signal for the exposure lamp is output at any time, irrespective of whether the lamp is lighted or not.

Further, a zero cross signal created by a zero cross generation circuit is input into the controller for the connection to the microcomputer. By monitoring the time Tc from the zero cross signal to the trigger signal for the exposure lamp, the variation in the input voltage can be read.

In this image forming apparatus, the lamp lighting voltage Vc is adjusted so that the illuminance on the plane of photosensitive drum may be constant for each device, this lamp lighting voltage Vc being stored in the non-volatile memory. The AC input voltage Emax can be obtained, using the stored lamp lighting voltage Vc and the time Tc from the zero cross signal to the trigger signal for the exposure lamp, from the following expression.

$$\begin{aligned} Erms^2 &= \int_0^T Emax^2\sin^2(2\pi/T)\cdot tdt/T \\ &= Emax^2/2 \end{aligned} \tag{2}$$

where Emax is a peak voltage of the AC input voltage.

$$\begin{aligned} Vc^2 &= \int_{Tc}^{T/2} Emax^2\sin^2(2\pi/T)\cdot tdt/T/2 \\ &= Emax^2/2\cdot(1-2Tc/T+1/2\pi\cdot\sin(4\pi Tc/T)) \end{aligned} \tag{3}$$

From the above two expressions (2) and (3), $$Erms^2/Vc^2=1/\{1-2\times Tc/T+\text{Sin}\,(4\pi Tc/T)/2\pi\} \tag{4}$$

From the expression (4), $Erms^2/Vc^2$ is obtained by substituting the time Tc from the zero cross signal to the trigger signal for the exposure lamp into that expression, so that the AC input voltage Erms can be obtained using the lamp lighting voltage Vc stored in the non-volatile memory.

In this example, $Erms^2/Vc^2$ is obtained from the value Tc in the table stored in a ROM.

Next, the heater control will be described. This heater is a heater having a resistor printed on the ceramic substrate as previously described, and is greatly superior in the heat responsibility. With the normal ON/OFF control, the ripple may become larger at the warm tone temperature, or excessive electric power applied to the heater, damaging the heater. Hence, for this control, the power control for applying a constant power is performed. Also, to reduce the ripple, the electric power is controlled to be switched depending on the temperature sensed by the thermistor.

Referring now to FIGS. 5A to 5C, the power control of the heater will be described below. The power of the heater is phase controlled, like the control of the exposure lamp. Since the heater is purely resistance loaded, the electric power W can be obtained by:

$$W=V_H^2/R \tag{5}$$

$V_H$: voltage supplied to the heater

R: Resistance value of heater

Since the resistance value R of the heater is stored in the non-volatile memory for each individual image forming apparatus, and the electric power supplied to the heater is known, the voltage $V_H$ applied to the heater can be obtained from the above expression such that:

$$V_H^2=R\times W \tag{6}$$

Also, from the expression of effective voltage, the voltage $V_H$ applied to the heater is:

$$V_H=\sqrt{\left(\int_{T_H}^{T/2} Emax^2\cdot\sin^2(2\pi/T)\cdot tdt\right)/T/2} \tag{7}$$

$$V_H^2=Erms^2(1-2T_H/T+1/2\pi\sin\,(4\pi T_H/T)) \tag{8}$$

$$Erms^2/V_H^2=1/\{1-2T_H/T+\sin\,(4\pi T_H/T)/2\pi\} \tag{9}$$

By computing $VH_H^2$ from the expression (6) and $Erms^2$ from the expression (4), $Erms^2/V_H^2$ can be obtained, so that the time $T_H$ from the zero cross signal to the trigger signal of the heater can be obtained from the expression (9).

Note that in this example, $T_H$ is obtained from expression (9).

Note that in this example, $T_H$ is obtained from $Erms^2/VH_H^2$ using a table.

The electric power control for the heater is made in accordance with the algorithm as above described.

This electric power control for the heater is always made during the copying period so that the temperature of the heater is maintained constant.

Next, the heater control for the fixing unit 21 will be described. A heater portion 43 is a part of resistor having 43*a* printed, and divided midway into five branches as shown in FIG. 9. And the conduction to each branch is controlled in accordance with the paper size. That is, because the temperature in the non-passing paper portion (through which no paper passes) is too higher than that of the passing paper portion (through which the paper passes) in the heater, the resistor is branched from the non-passing paper portion to reduce the total electric power applied from that branch portion to the ahead portion (non-passing paper portion) to decrease the temperature. Of course, when branch conducting, the total electric power is controlled so that the temperature of the passing paper portion may be constant.

Figure 10:
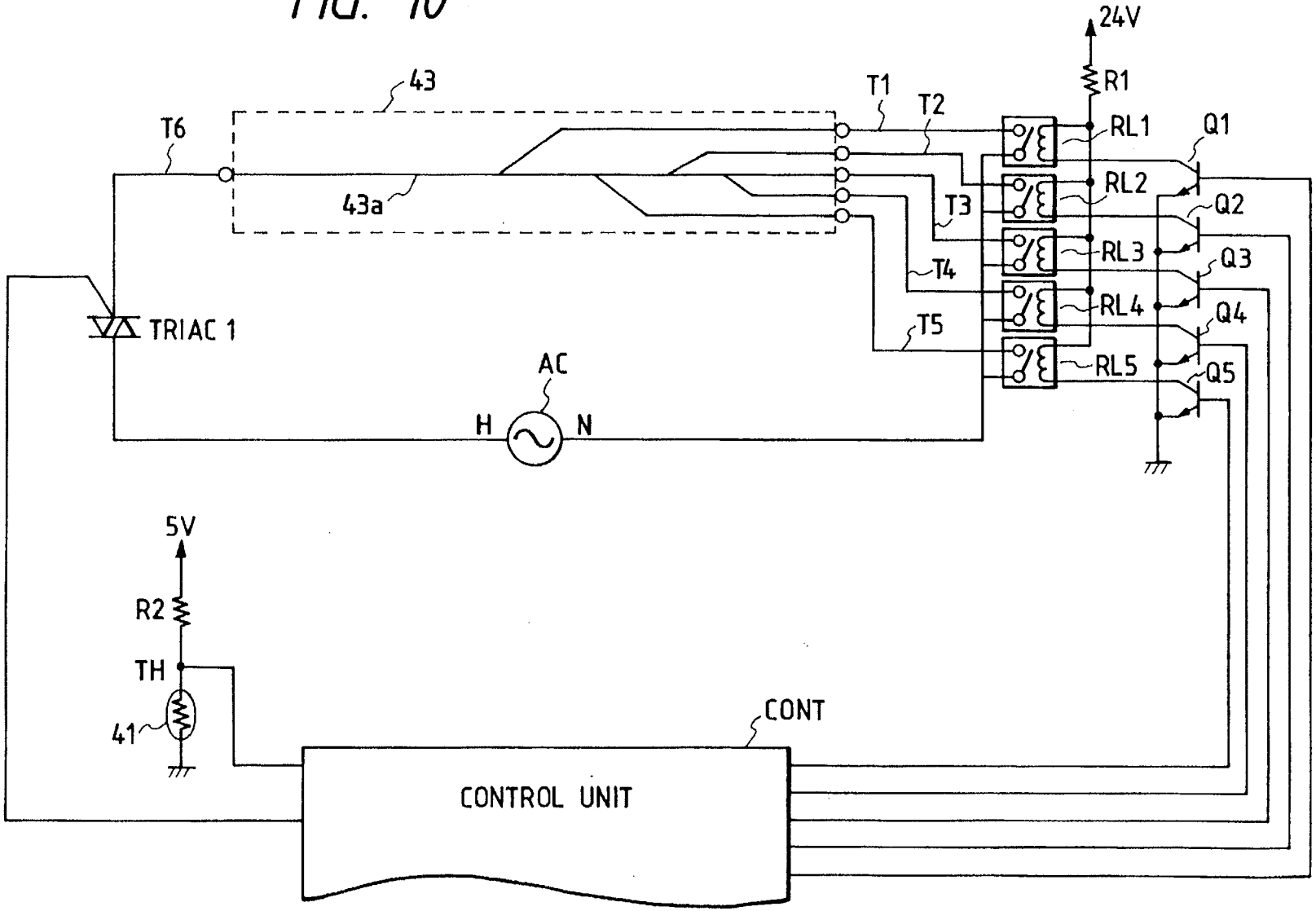
FIG. 10 is a circuit diagram showing a heater drive control portion.

FIG. 10 is a circuit diagram representing the electric wirings of the heater portion for the fixing unit. Herein, T1 to T6 are heater terminals. And the terminals T1 to T5 are connected to the neutral side N of the AC power supply via the relays RL1 to RL5 in accordance with the signal from a controller CONT. A triac 1 serves as the switch between a terminal T6 and the hot side H of the AC power supply through the use of a signal from the controller CONT.

As the practical operation, for example, when the copy paper of B4 is used, the controller CONT outputs an HIGH signal to the bases of the transistors Q3 and Q4 to turn on the switches of RL3 and RL4 for the connection of the branch end leading thereto to the ACN line. And by supplying a signal which turns on the triac 1, the resistor leading to the terminals T3 and T4 are caused to conduct.

The controller CONT turns on/off the triac 1 so that the voltage applied to the heater (effective voltage) may be at a predetermined constant voltage (phase control). Also, the conduction is controlled so that the heater portion be at a predetermined temperature, based on a signal from a temperature detection element 41 attached to the heater portion.

FIG. 11 shows the conduction state of the branch end in accordance with the size of each copying paper.

The suppression of the ripple (overshoot) will be described below to maintain the heater portion at a predetermined temperature. In the previous explanation, the maximum power is applied until a predetermined temperature is reached, upon sensing the predetermined temperature or above, the conduction to the heater is turned off, and below the predetermined temperature, the maximum power is supplied again. Hence, the temperature variation due to overshoot may become large. Thus, the applied power (voltage) P is changed in the following way, depending on the difference between the temperature detected by the temperature detection element 41 (see FIG. 10) attached to the heater portion and the predetermined temperature.

$$P=K_P(T_G-T_R)[W] \quad (10)$$

$K_P$: proportional constant [W/° C.]

$T_G$: target temperature [° C.]

$T_R$: detected temperature [° C.]

Accordingly, by changing the above $K_P$, various controls can be effected. For example, if $K_P$ is made smaller, the temperature control with less overshoot can be effected, but the response rate is slowed. 0n the contrary, if $K_P$ is increased, the response rate becomes higher but the overshoot is increased. Also, as the electric power P is changed in accordance with the paper size (i.e., the way of branching), the optimal value of $K_P$ is obtained by performing the test ahead.

It should be noted that the computation time of the CPU in the microcomputer can be shortened in such a manner that the electric power to be applied is precomputed, and tabulated in accordance with the temperature range and the paper size, as shown in FIG. 12, this data is input into the ROM of microcomputer, and the application power is extracted from the table in accordance with the detected temperature.

Figure 13:
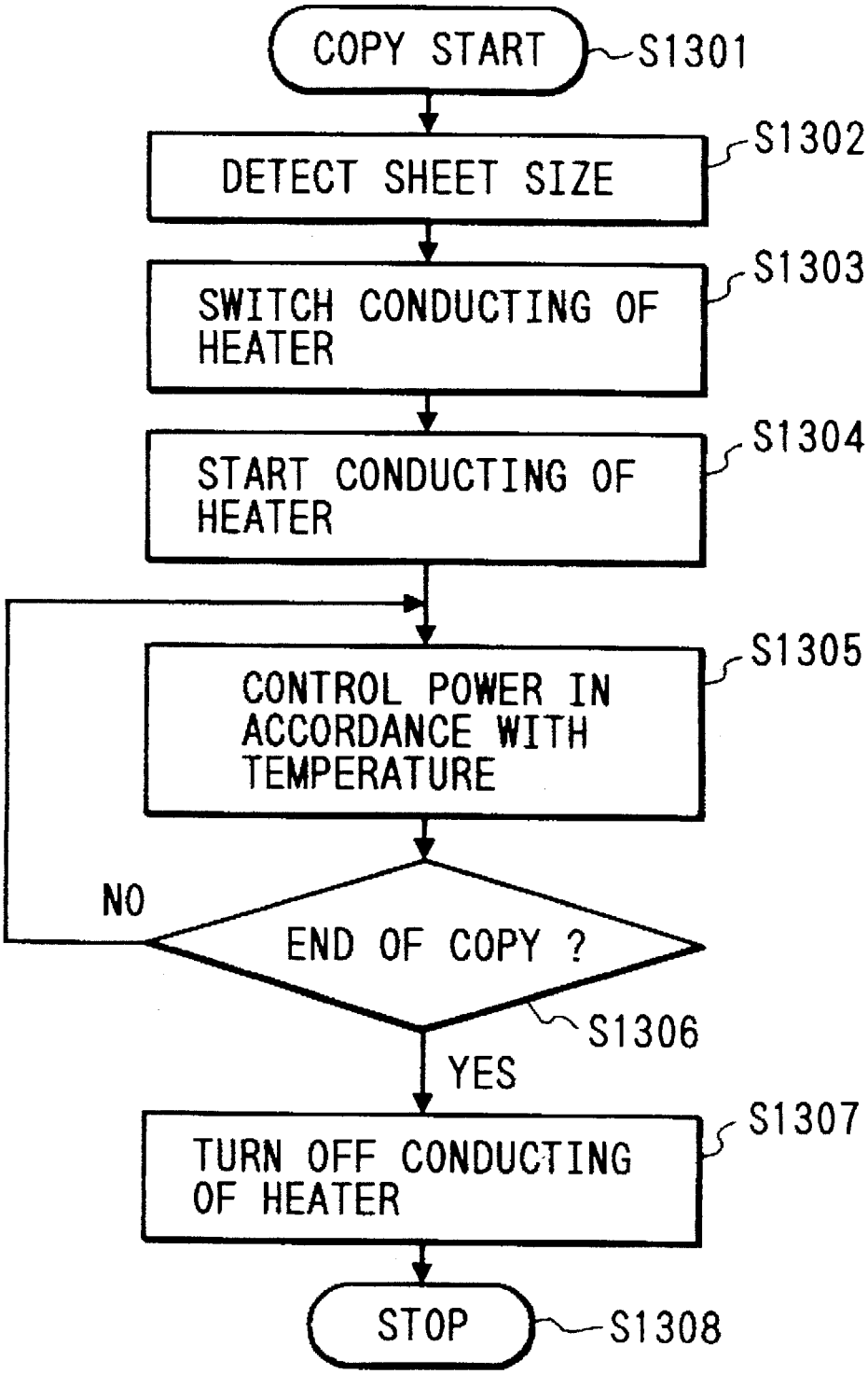
FIG. 13 is a flowchart showing a control procedure in an example 1.

Finally, a flowchart representing the operation of this fixing heater is shown in FIG. 13. The copying is started (S1301) upon depressing the copy button, and the size of the used copy paper is sensed by size sensing means (S1302). Then, the switching of conduction is made in accordance with the paper size detected as shown in FIG. 11 (S1303). Thereafter, the conduction to the heater is started (S1304), and the power control is made in accordance with the temperature of this example until the termination of the copy operation (S1305 to S1308).

Next, the switching of the heater branch end will be described.

The contact portion of the branch end for the heater produces the electric noise upon the switching, which electric noise has the possibility of adversely affecting the other electric circuit.

In this example, to reduce the electric noise, the switching of the branch end for the heater is made when not conducting. The control is shown in FIGS. 14A to 14F.

Figures 14A, 14B, 14C, 14D, 14E, 14F:
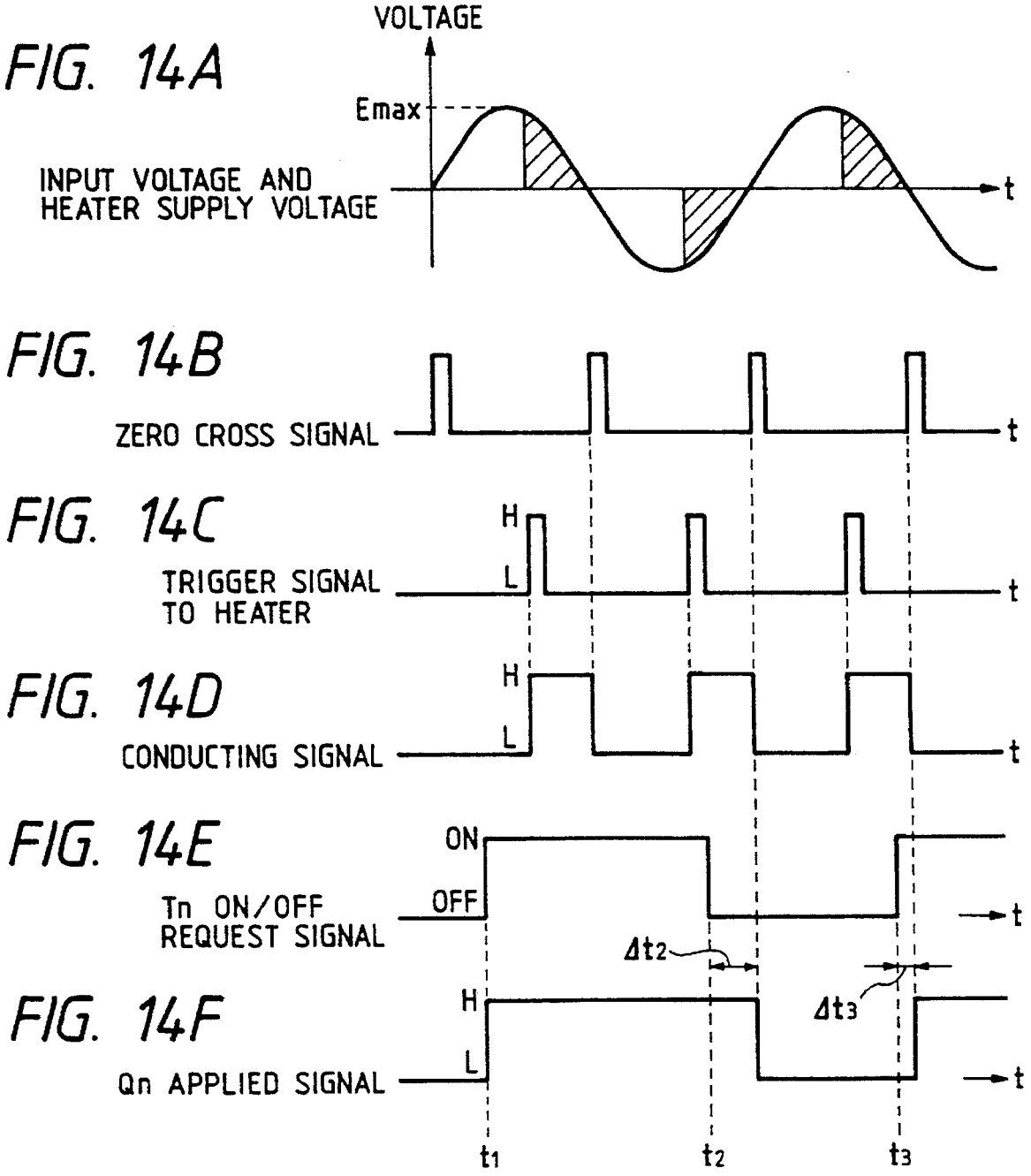
FIGS. 14A to 14F are timing diagrams showing the switching of conduction in the example 1.

In FIGS. 14A to 14F, FIG. 14A is a graph representing the input voltage and the voltage supplied to the heater, FIG. 14B represents the zero cross signal for detecting the point at which the input voltage reaches zero, and FIG. 14C represents the trigger signal for use in controlling the conduction to the heater. FIG. 14D represents the conduction signal indicating whether or not the heater is conducting, which signal is formed of the signals of FIGS. 14B and 14C. FIG. 14E represents the conduction on/off request signal of conduction of the branch Tn (n=1 to 5) which is output from the controller CONT (see FIG. 10), and FIG. 14F represents the signal to the transistor Qn (n=1 to 5) for controlling the conduction/non-conduction to the branch.

At the time $t_1$, the application signal to Tn is turned on in synchronism with the on signal from the controller CONT in FIG. 14E to the branch Tn. At the time $t_3$, the application signal to Tn is turned on after $\Delta t_3$ upon the off signal from the controller CONT. Since at the time $t_1$, the conduction signal to the heater in FIG. 14D is L (OFF) for the on signal of FIG. 14E, the application voltage to Tn is immediately turned on, while as at time $t_3$, the signal of FIG. 14D is H (ON) for the on signal of FIG. 14E, the application voltage to Tn is turned on after $\Delta t_3$ at which the signal of FIG. 14D is turned off.

The case where the application voltage to Tn is turned on and then off is likewise handled, wherein as at time $t_2$, the conduction signal of FIG. 14D is H (ON), the application voltage to Tn is turned off after A $t_2$ at which the conduction signal of FIG. 14D is turned off.

As above described, by controlling the conduction to the branch Tn, the electric noise at the branch contact portion can be eliminated.

EXAMPLE 2

Figure 15:
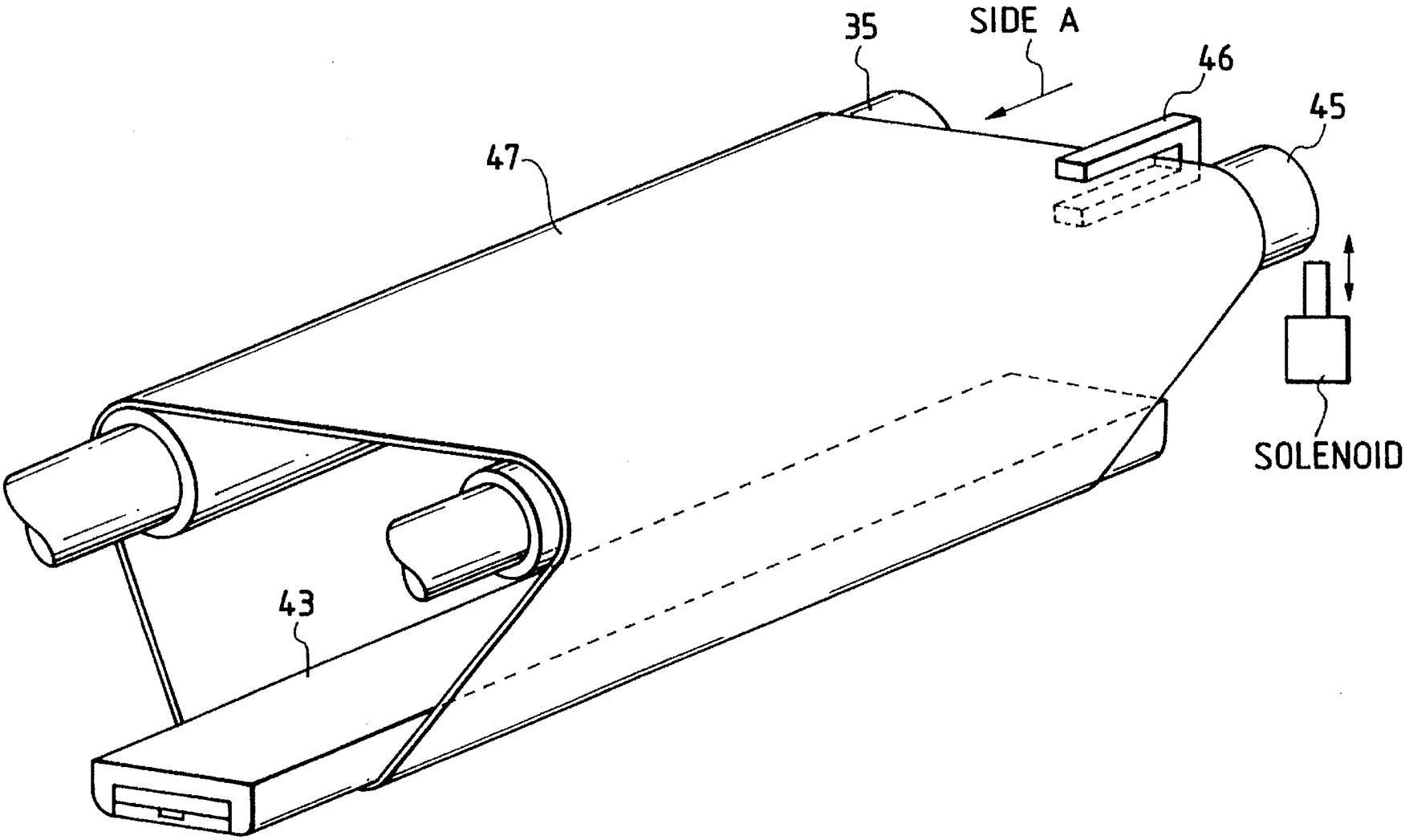
FIG. 15 is a view showing a fixing unit in an example 2.

FIG. 15 is an external view of a fixing unit in an example 2 of the present invention. In FIG. 15, 43 is a heater having a heat generating resistor having a plurality of branches (hereinafter referred to as a branched heater). The arrangement of a conducting portion for the branched heater 43 is as shown in FIG. 9. This branched heater 43 is provided to select the conducting portion in accordance with the size of the paper passing through the fixing unit.

The selection of the conducting portion for the branched heater 43 in accordance with the paper size is aimed to prevent the uneven temperature distribution on the surface of the heater 43 due to being deprived of the heat by the paper, when the paper passes by the heater 43, because if the temperature on the surface of the heater 43 is uneven, the film 47 is moved toward the side of higher temperature, thereby causing a film slippage.

The selection of the conducting portion for the branched heater 43 is performed as shown in FIG. 9. That is, when the paper is of the A3 or A4 size, the conduction is selectively made at the (0) point and (1) point. When the paper is of the B5 or B4 size, the conduction is made at the (0) point, the (1) point and the (2) point. When the paper is of the A4R or A5 size, the conduction is made at the (0) point, the (1) point and the (3) point. When the paper is of the B5R size, the conduction is made at the (0) point, the (1) point and the (4) point. When the paper is of the A5R or less size, the conduction is made at the (0) point, the (1) point and the (5) point.

Figure 16:
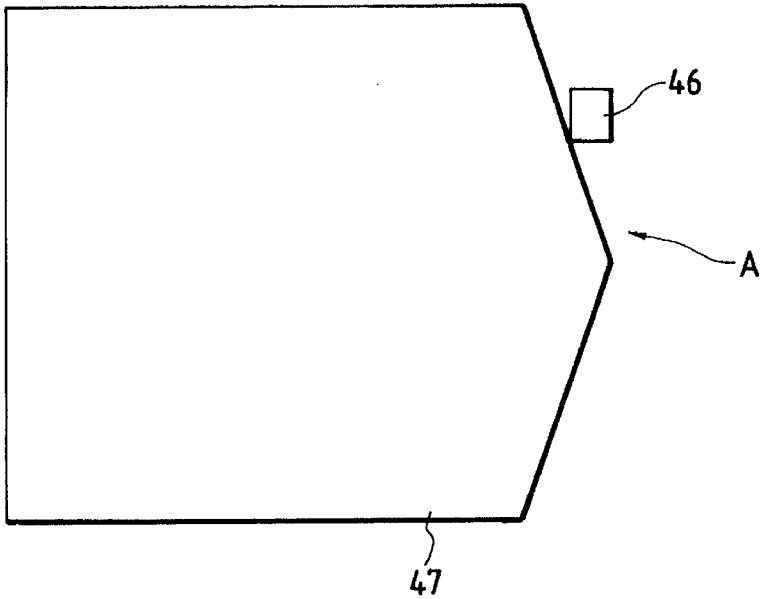
FIG. 16 is an expanded view of an endless film in the fixing unit as shown in FIG. 15.

FIG. 16 shows an expanded view of an endless film 47 for the fixing unit. In this figure, one side of the endless belt 47 is obliquely cut to sense the film slippage as will be described later.

On the side in which the film 47 of the fixing unit is obliquely cut, a photo-interrupter 46 is provided to detect the position of the film 47 as shown in FIG. 15. This arrangement of using the photo-interrupter 46 is such that if a light receiving portion senses a light from a light emitting portion, the low level is output, and if the light from the light emitting portion is shielded, the high level is output.

Figure 17:
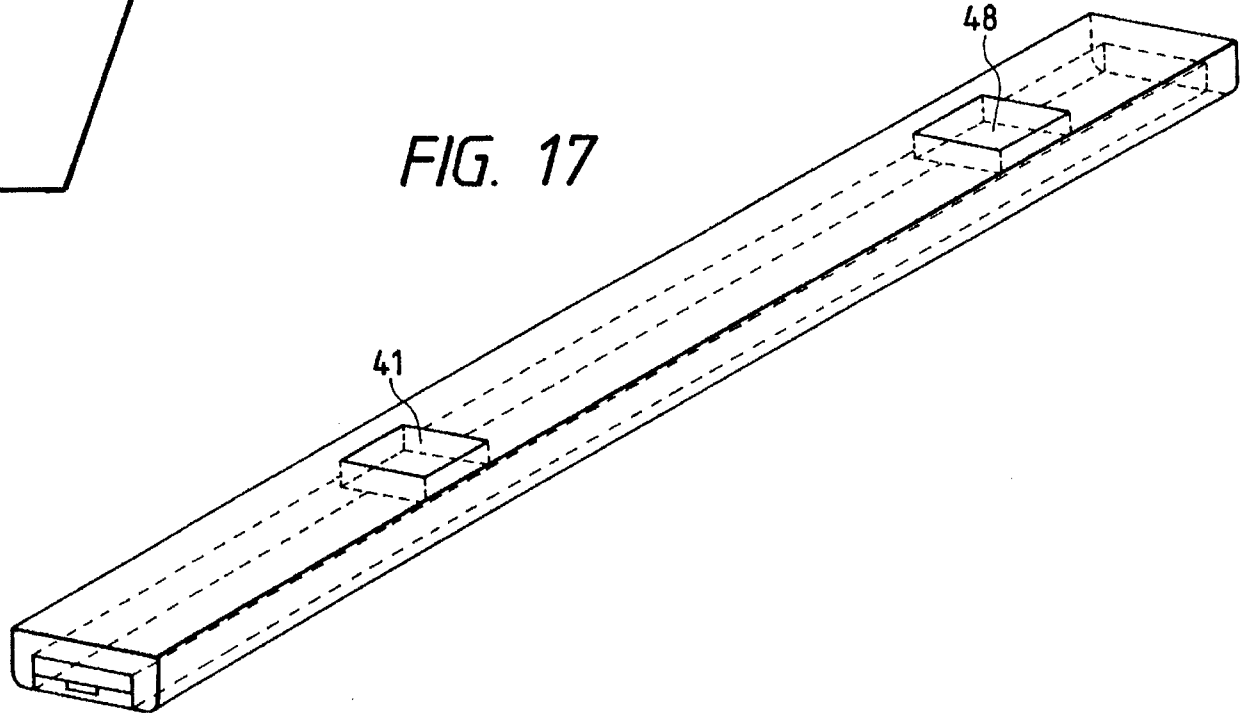
FIG. 17 is an external view of a fixing heater.

Also, the heater 43 has a plurality of temperature detecting means 41, 48 (hereinafter referred to as a thermistor), as shown in FIG. 17. A thermistor 41 is inserted from the back side of the conducting portion for the heater 43 into the heater 43, while a thermistor 48 is attached to the metallic stay. The thermistor 41 is attached to the passing paper portion, while the thermistor 48 to the non-passing paper portion. The detected results from these two thermistors are identical during the time of not passing the paper, but if starting passing the paper, the temperature of the passing paper portion will drop because the heat is deprived by the paper. Two thermistors are attached to obtain the temperature difference between the passing paper portion and the non-passing paper portion.

Next, the slippage of the endless film 47 and the output from the photo-interrupter 46 will be described. As one side of the film 47 is obliquely cut, the high level is output if the film 47 shields the light from the light emitting portion within the photo-interrupter 46, while the low level is output if the film 47 does not shield the light. Where the film 47 is rotated around the exactly same position without causing any slippage, the duty ratio of the output from the photo-interrupter 46 is always constant. However, if the position of the film 47 is moved in a direction of the roller shaft, the duty ratio of the output from the photo-interrupter 46 is changed corresponding to the slippage of the film 47.

Specifically, if the film 47 approaches to the photo-interrupter 46, the output time of the high level from the photo-interrupter 46 lasts longer, while if the film 47 is far away from the photo-interrupter 46, the output time of high level is shorter. The microcomputer Q1 of FIGS. 3A and 3B measures the output time of high level from this photo-interrupter 46, wherein if the high level output beyond the set time continues for a number of periods, the solenoid (not shown) is driven to change the tension of a tension roller 45 to mend the slippage of the film 47.

The above operation is a basic endless film slippage control in the fixing unit.

The above description is commonly applicable to the first and second examples.

Next, the conduction control for the fixing heater when in the continuous copying, which is characteristic in this example, will be described.

Figures 1, 2, 18A, 18B, 18C:
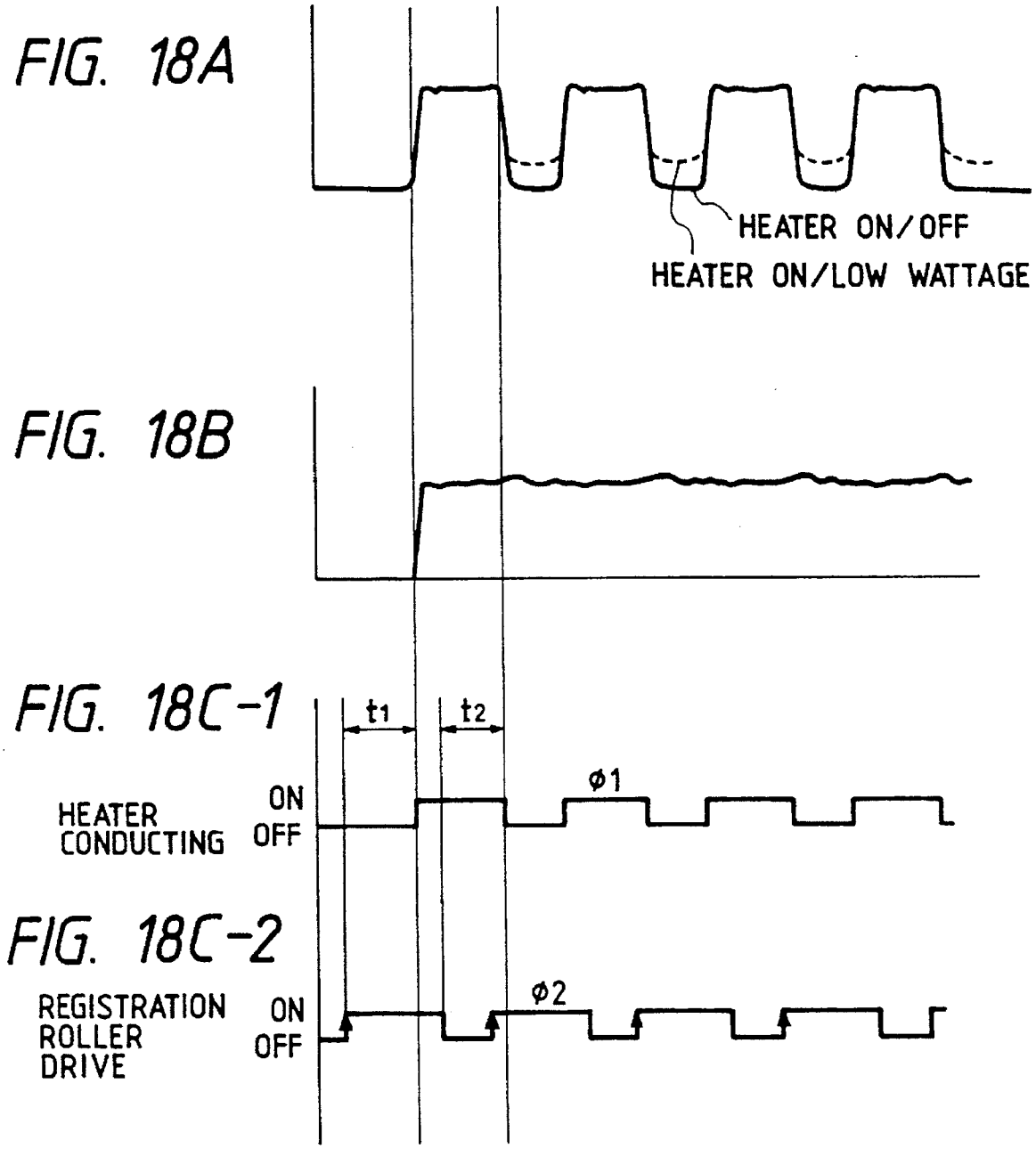
FIGS. 18A to 18C-Z are graphs representing the heater temperature variation when forming a continuous image in the example 2, the temperature variation on the heater surface in effecting the conventional continuous copying, and the timing for applying the electric power for the fixing temperature to the heater in this example, respectively.

FIG. 18A is a timing chart of the heater temperature with the paper-to-paper wattage control in this example, and FIG. 18B is a timing chart of the heater temperature when in the conventional continuous copying. FIGS. 18C-1 and 18C-2 show a timing chart of the heater on/off control in this example with the signal Φ1, and that of the signal for driving the registration roller with the signal Φ2, respectively.

In FIG. 18A, the solid line indicates the temperature variation when the heater conduction is turned off between papers, and the dotted line indicates the temperature variation when the wattage applied to the heater is lowered between papers.

In the signal Φ2 of FIG. 18C-2, the high level indicates the time for which the registration roller is driven, and the low level indicates the time for which the registration roller is stopped. Also, in the signal Φ1 of FIG. 18C-2, the high level is the time for which the wattage of the fixing temperature is applied to the heater, and the low level is the time for which the conduction to the heater is turned off or the low wattage is applied to the heater.

Note that the signal Φ2 of FIG. 18C-2 is generated from the image leading signal as previously described by counting with a counter within the microcomputer Q1.

As shown in FIG. 18C-1 and 18C-2, the wattage for the fixing temperature is applied to the heater after the elapse of a certain time $t_1$ from the rising of the registration roller drive signal Φ2. Then, the conduction to the heater is turned off or switched to the lower wattage after the elapse of a certain time $t_2$ from the falling of the registration roller drive signal Φ2.

Since the registration roller is active while the paper is passing, the heater is turned on/off or the wattage control is made for every paper even in the continuous copying only as long as the paper is passing through the fixing unit by effecting the conduction to the heater based on the registration roller drive signal Φ2.

Figures 19, 19A:
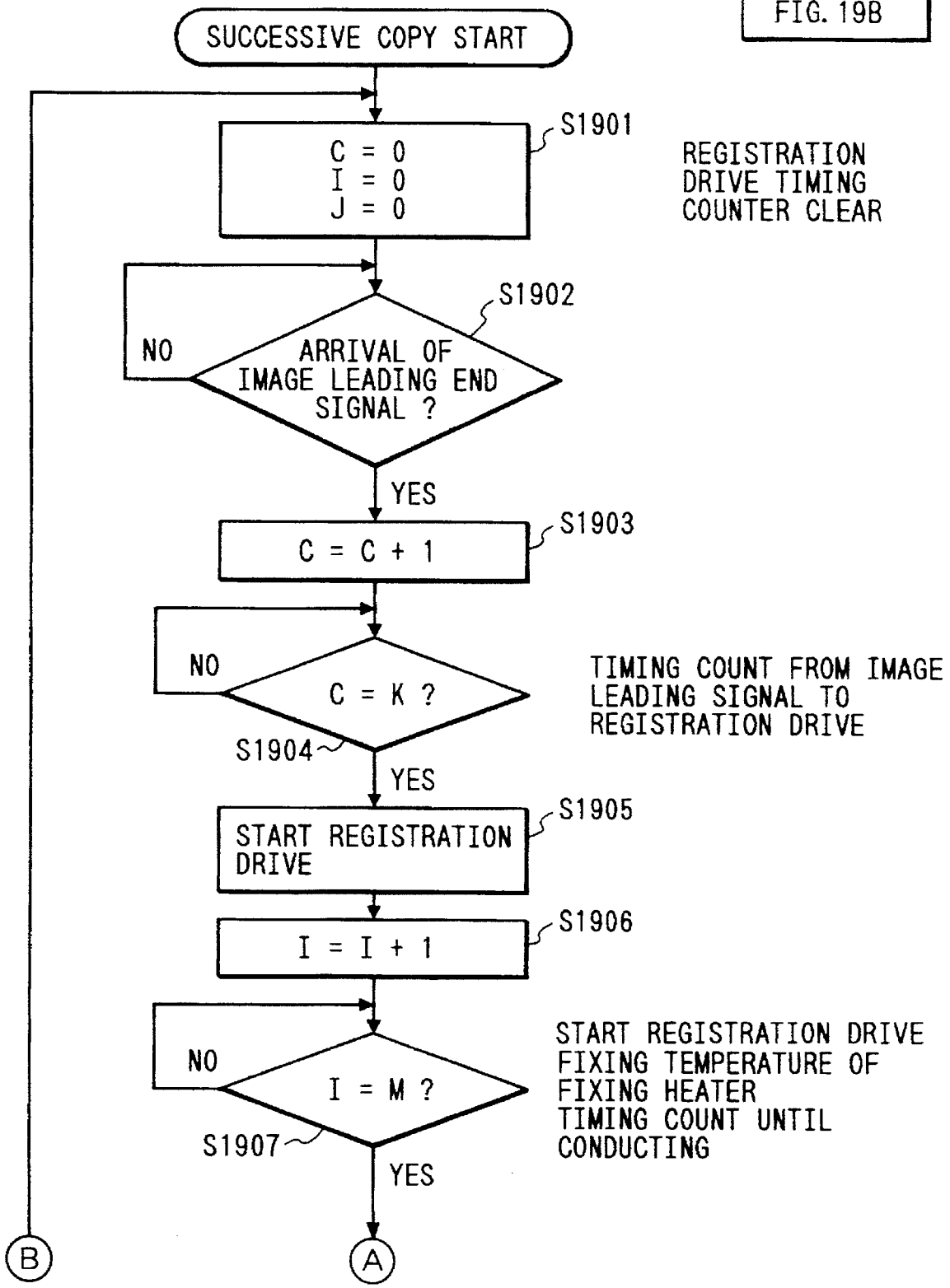
FIG. 19 which is comprised of FIGS. 19A and 19B is a flowchart showing a control procedure in the example 2.
Figure 19B:
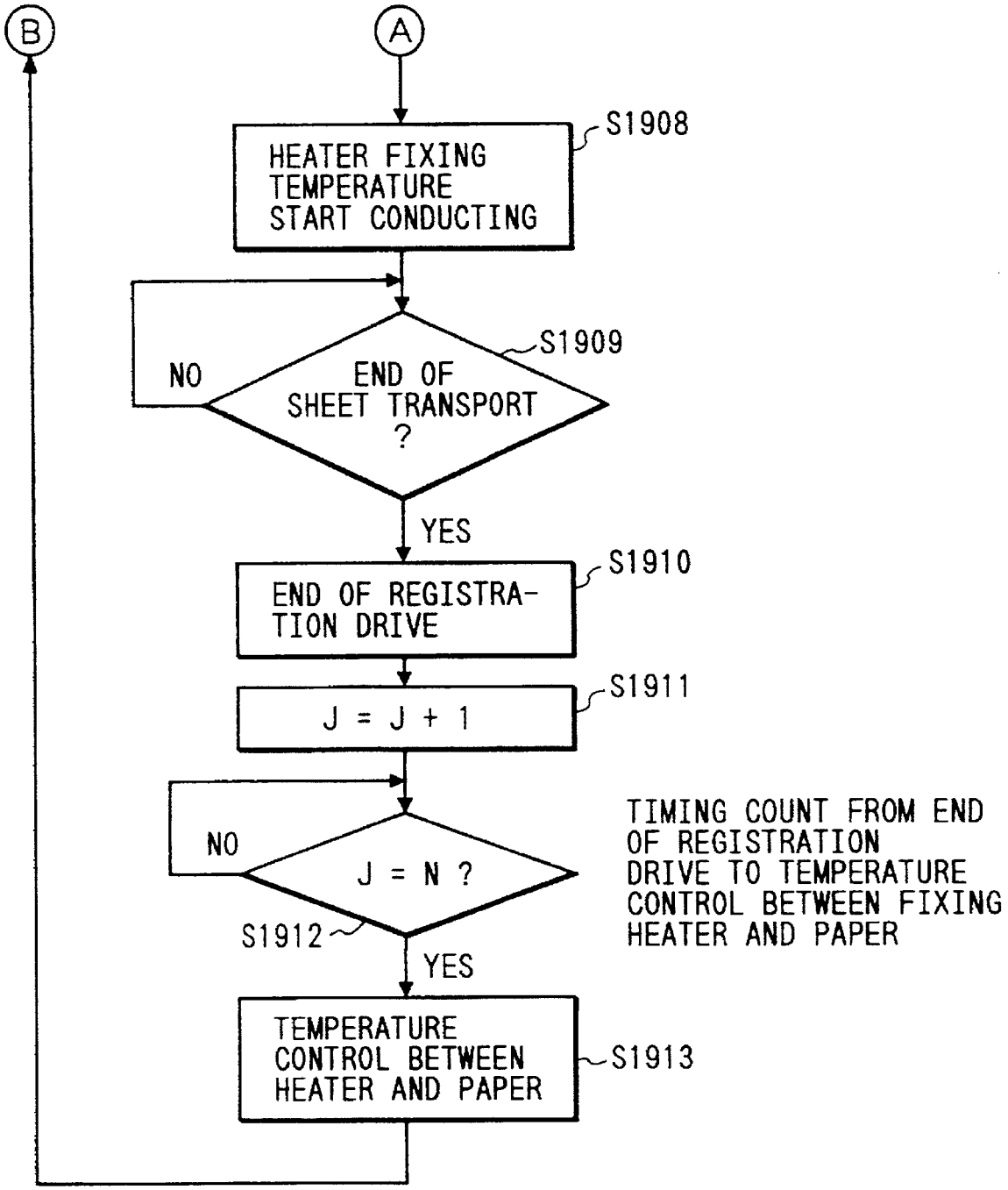

Next, a method in which the conduction to the heater is turned off between papers or controlled to the lower wattage will be described. First, the ambient temperature at the stand-by is stored by the thermistors 41, 48 as previously mentioned. When the ambient temperature is high, the heater conduction is turned off while the paper is not passing in the continuous copying. When the ambient temperature is low, the electric power set at a lower temperature than the fixing temperature is applied to the heater. In this case, the difference between the fixing temperature and the low wattage control temperature is set to be constant at any time. If the difference between the fixing temperature and the low wattage control temperature when the paper is not passing is maintained constant, the rising time of the heater can be fixed without regard to the ambient temperature. FIGS. 19A and 19B shows a flowchart of this example. Note that the description for the details of this flowchart is omitted.

EXAMPLE 3

A third example of the present invention will be described below.

Figure 20:
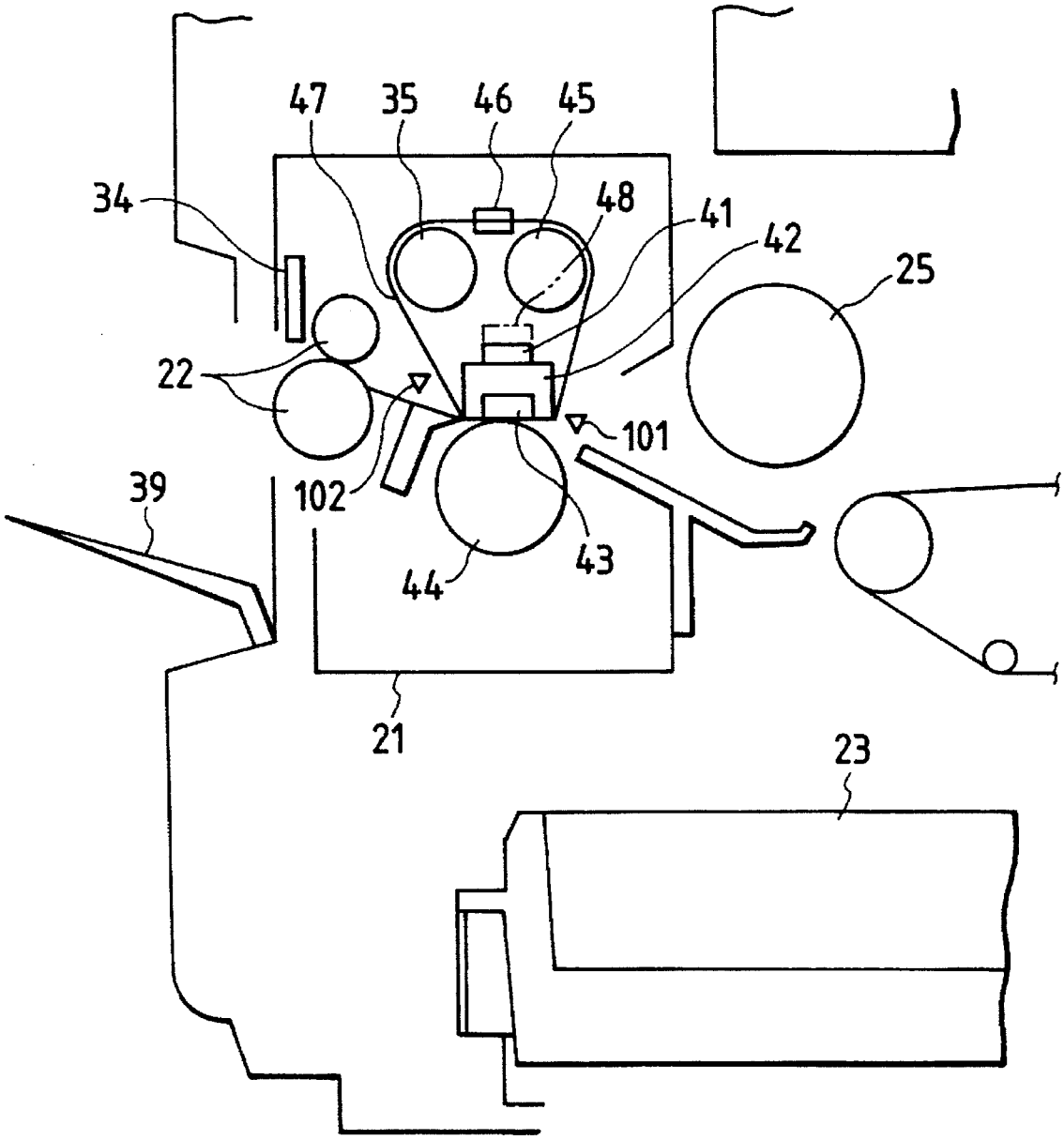
FIG. 20 is a constitutional view of an example 3 of the present invention, in cross section.

FIG. 20 is a cross-sectional constitutional view of the example 3. In this example 3, the fixing heater is turned on/off based on the output from the photo-interrupter. Other constitutions and operations are the same as in the first example, and is not described any more.

Figure 21:
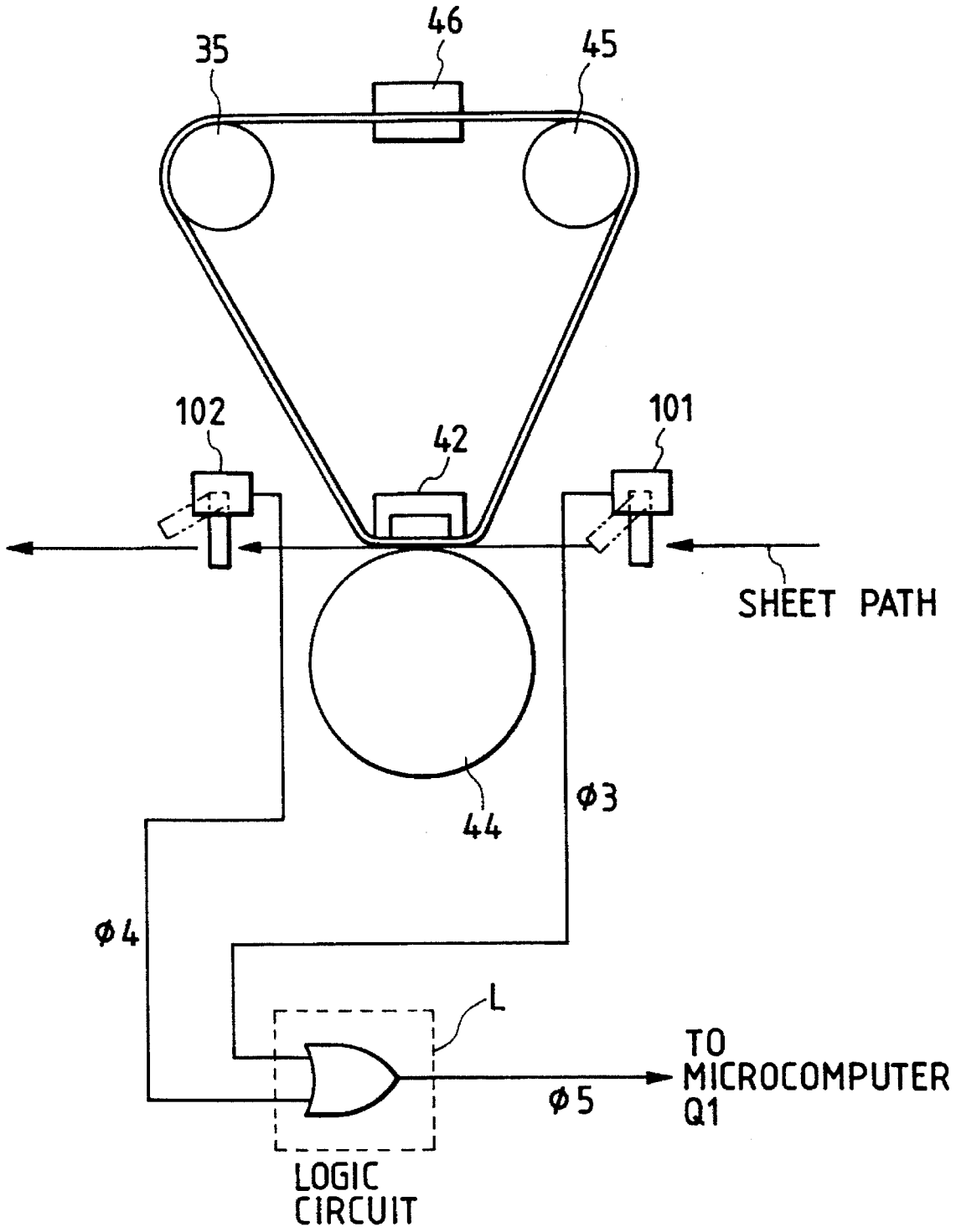
FIG. 21 is a typical view showing a constitution of the example 3.
Figures 22A, 22B, 22C:
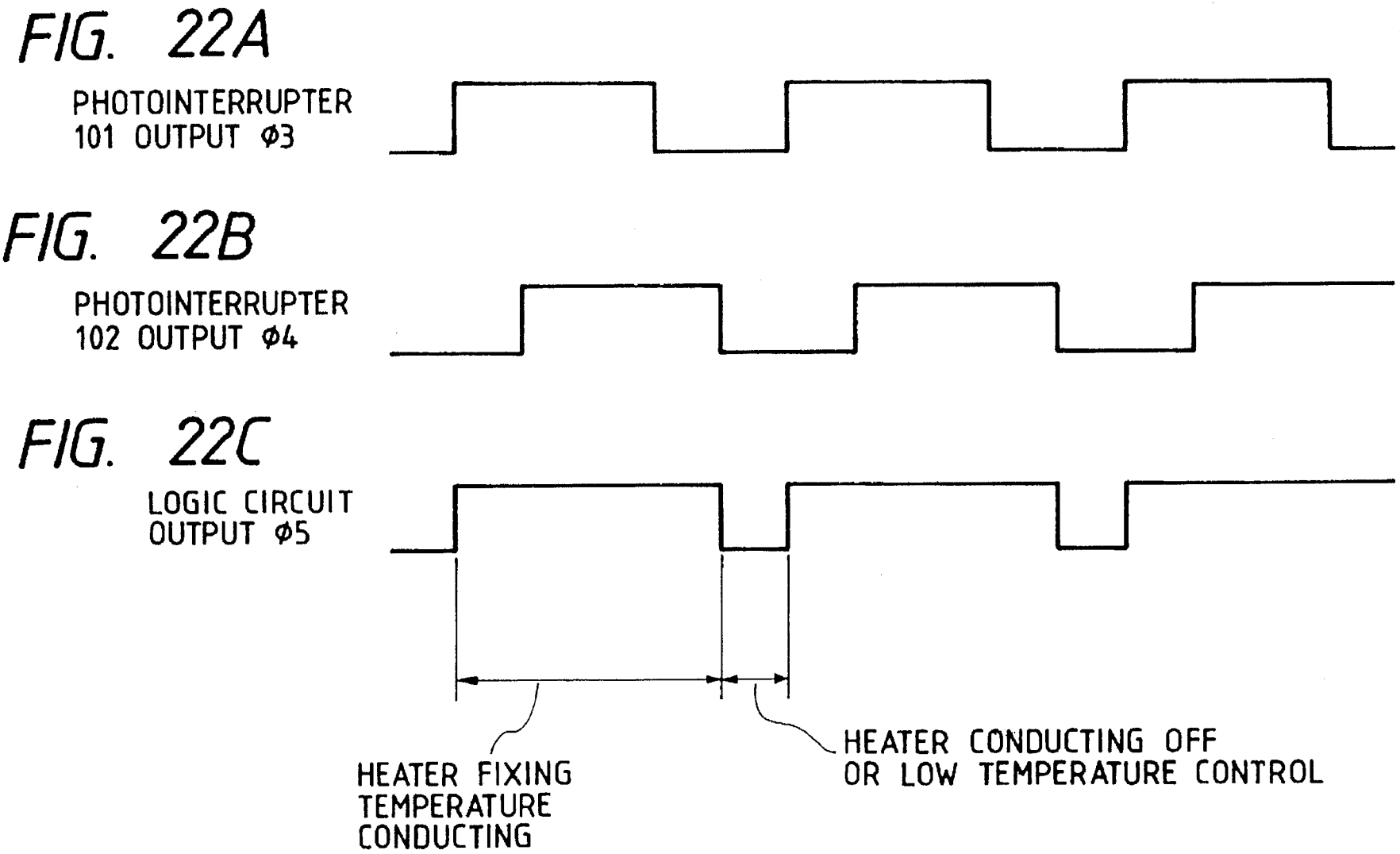
FIGS. 22A to 22C are timing charts showing the operation of the example 3.

FIG. 21 is a typical view of the constitution of the example 3, and FIG. 22A to 22C are timing chart of the example 3.

As shown in FIG. 20, there are provided photo-interrupters 101, 102 for detecting the presence or absence of a paper at the entrance and exit of the fixing unit, the high level being output if the paper is detected.

In FIG. 22A, Φ3 is the output from a photo-interrupter 101, and in FIG. 22B Φ4 is the output from a photo-interrupter 102. As shown in FIG. 21, the output from the photo-interrupters 101 and 102 are operated by a logic circuit L to produce the on/off timing for the fixing heater. That is, the high level time of the logic circuit output Φ5 is a conduction time of the electric power for the fixing temperature. And the low level time is a conduction time when the fixing heater is turned off or at the low temperature.

In this example 3, the conduction time of the fixing heater for the fixing temperature is determined in accordance with the output from the photo-interrupters provided at the entrance and exit of the fixing unit, whereby the conduction is turned off between papers or controlled at the low temperature.

EXAMPLE 4

A fourth example will be described below.

Figure 23:
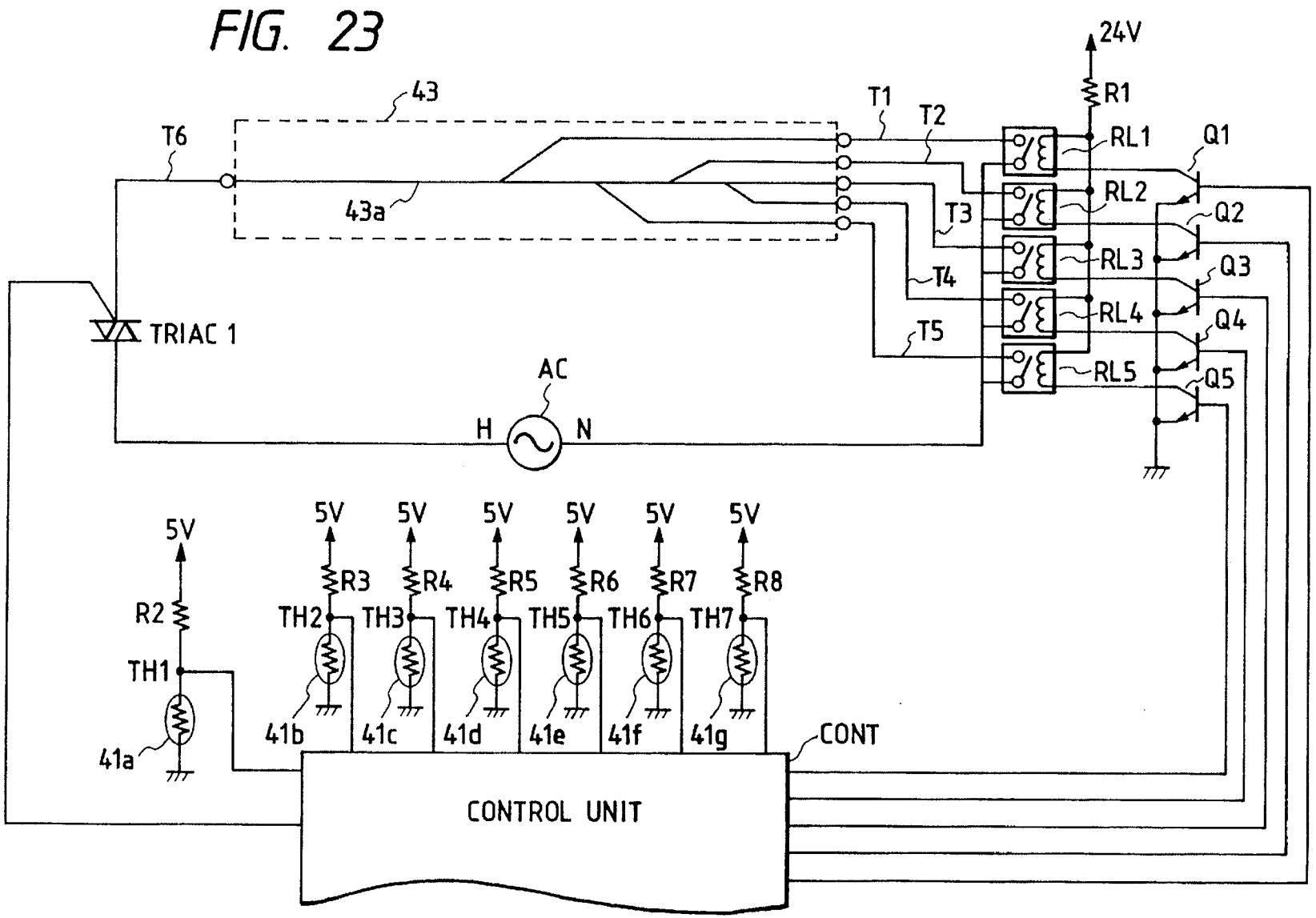
FIG. 23 is a circuit diagram showing a heater drive control portion in an example 4.

FIG. 23 shows a heater drive control unit of this example (corresponding to FIG. 10 as previously described). The conduction state of the branch end in accordance with the size of copying paper is similar to that of FIG. 11 as previously described. Also, the table listing the electric power in accordance with the temperature range and the paper size is similar to that of FIG. 12 as previously described.

Figure 24:
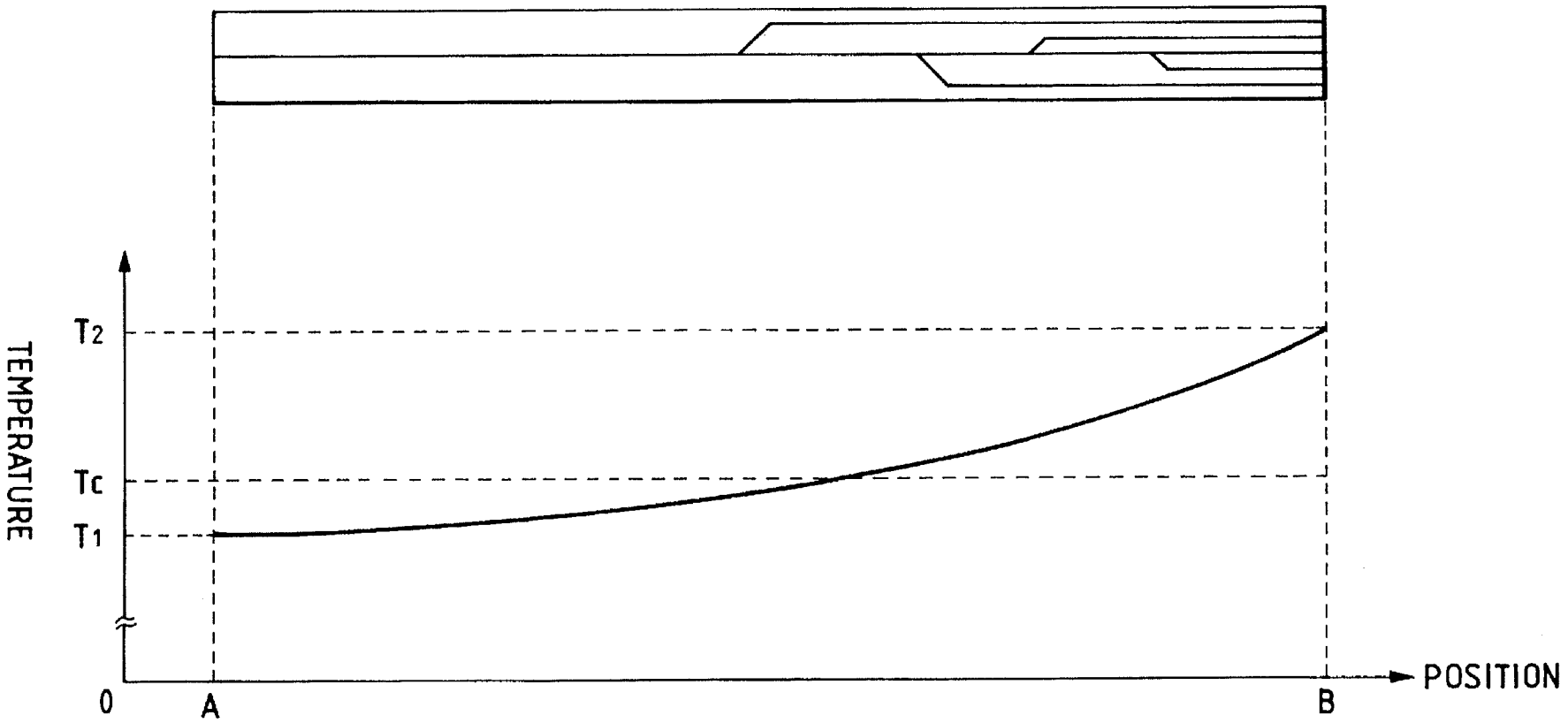
FIG. 24 is a graph for explaining the operation of the example 4.

A heat generating resistor can be used in which the temperature distribution is not uniform because of various factors in the manufacturing process. For example, it is assumed that a heater is fabricated in which the temperature distribution in conduction without branches is as shown in FIG. 24. In this figure, the temperature increases from the position A toward B.

Figure 25:
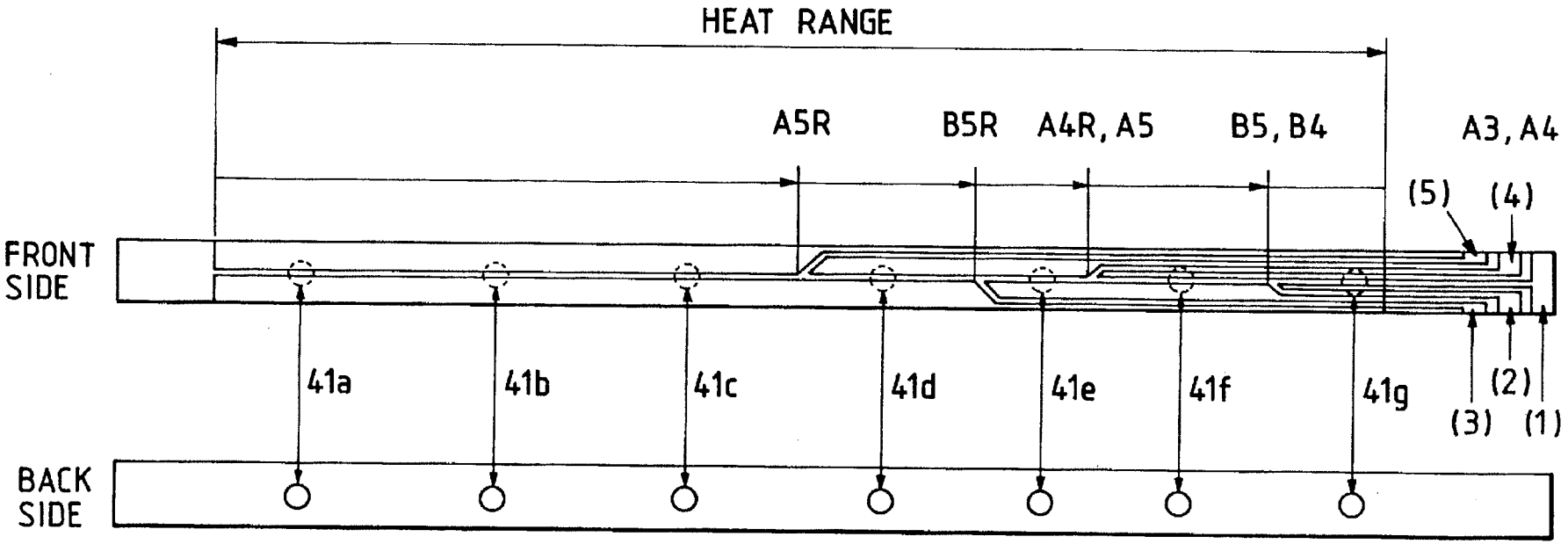
FIG. 25 is a view showing the positional relation between a temperature detecting element and a heater in the example 4.

For such a heater, if the temperature detection is tried by one temperature detection element (at a position 41*b* as shown in FIG. 25), the temperature is lower on the left side of that element, so that the unfixing may possibly occur. On the contrary, the temperature is so high on the right side of that element that the high temperature offset may possibly occur.

Thus, in this example, a plurality of temperature detection elements 41*a* to 41*g* are prepared as shown in FIG. 25, and in the case of a heater having the temperature distribution as shown in FIG. 24, the temperature detection element 41*g* is at the lowest temperature, whereby the temperature control is effected using this temperature detection element 41*g*. Further, in this case, the temperature in the right portion from the temperature detection element 41*b* is elevated, and therefore the branch conduction is switched as necessary, irrespective of the paper size.

For example, where the paper size is A4, with the temperature detection element 41*a* indicating the lowest temperature to be used for the temperature control, if the temperature detection element 41*g* exceeds a specified temperature, the branch conduction for B4 is effected to lower the temperature of the portion of the temperature detection element 41*g*. And when this branch conduction is continued so that the temperature detection element 41*g* is below a certain temperature, the branch conduction of B4 is stopped and the conduction of A4 is effected.

Figure 26:
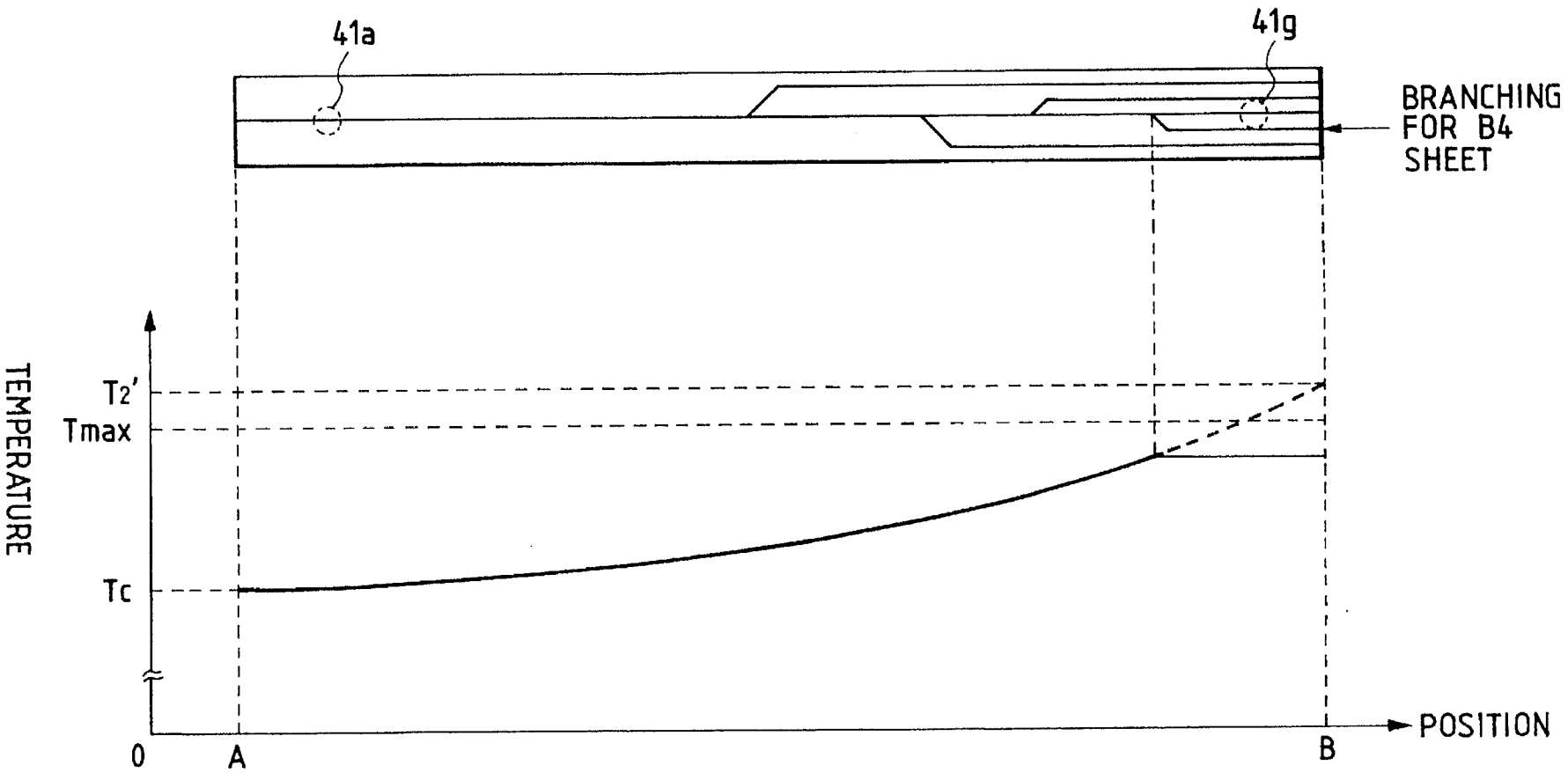
FIG. 26 is a graph for explaining the operation of the example 4.

By repeating this operation, the temperature control for the higher temperature portion can be made. This behavior is shown in FIG. 26. $T_2'$ indicated on the vertical axis of FIG. 26 is the highest achievable temperature when switched to the control by the temperature detection element 41*a* (the control temperature is $T_c$), and $T_{MAX}$ is the allowable maximum temperature.

Figures 27, 27A:
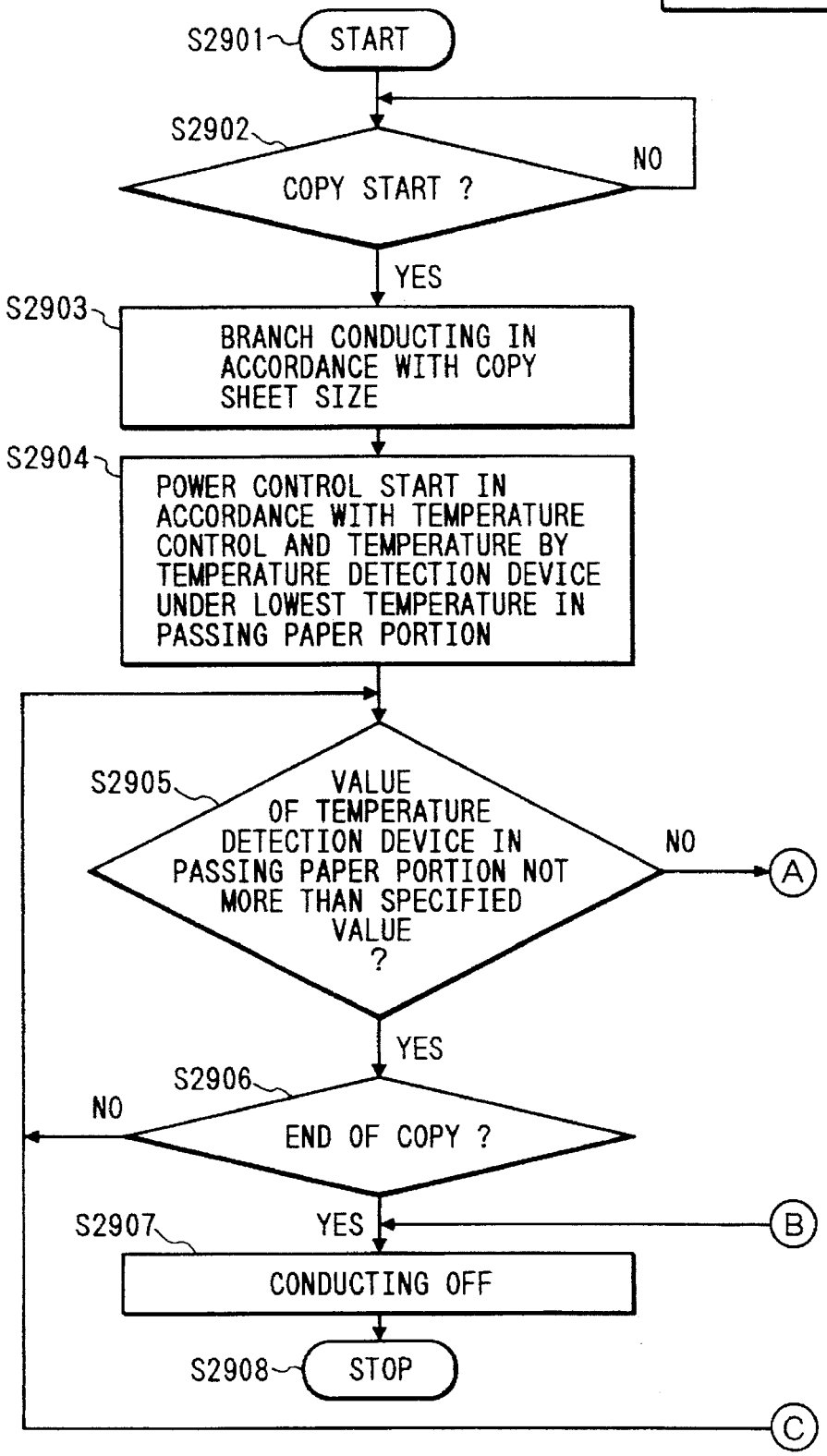
FIG. 27 which is comprised of FIGS. 27A and 27B is a flowchart showing a control procedure of the example 4.
Figure 27B:
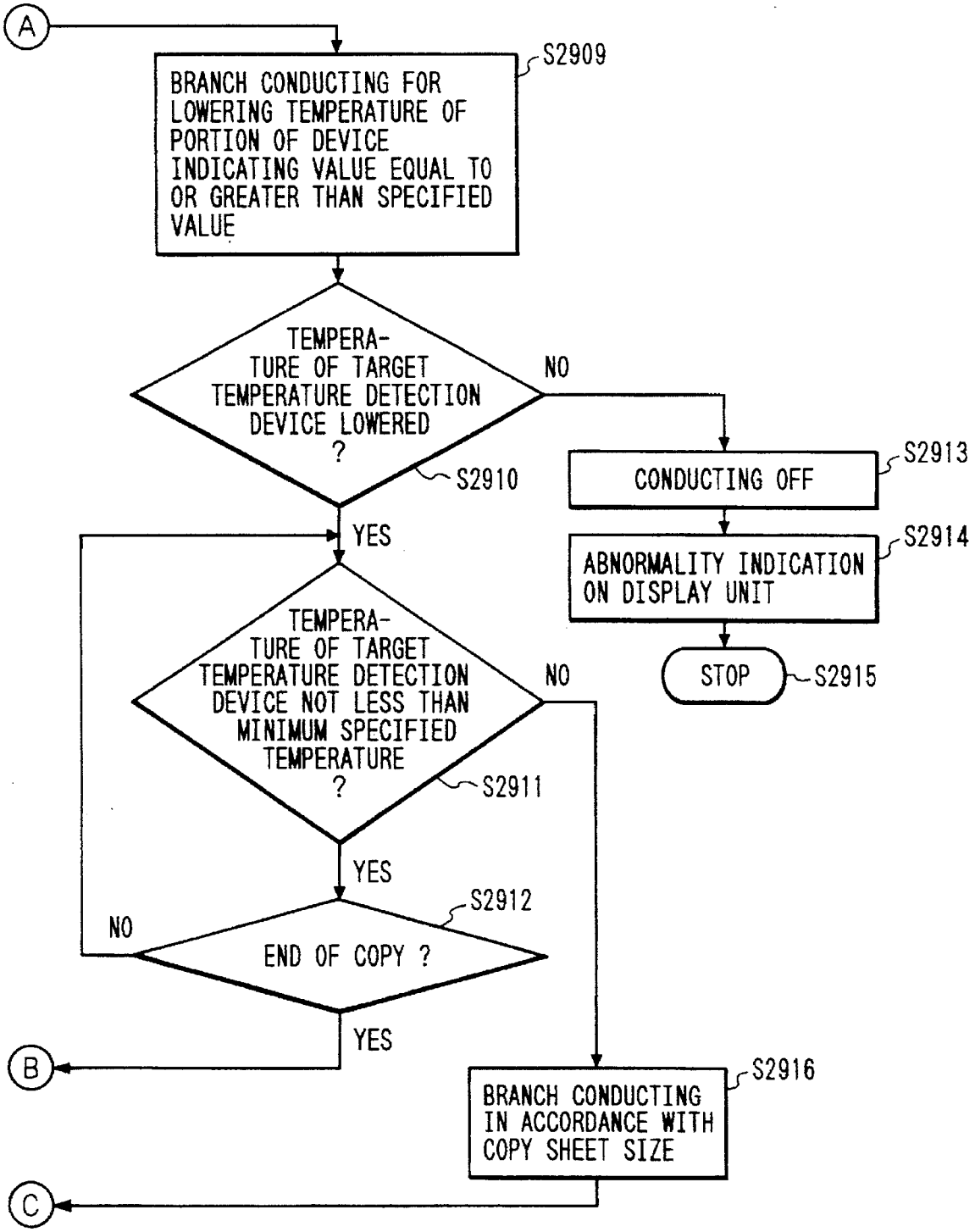

Finally, the control with this example will be described below in accordance with a flowchart as shown in FIGS. 27A and 27B.

First, if the copy is started (S2902), the branch conduction is effected in accordance with the copy sheet (S2903), and the temperature control by the temperature detection element indicating the lowest temperature in the passing paper portion and the electric power control in accordance with the temperature are started (S2904).

If all the temperatures detected by the temperature detection element in the passing paper portion are within a specified range, the warm tone is continued invariably until the copy end (S2905, S2906, S2907, S2908).

When there is any temperature detection element exceeding a specified value at step S2905, the switching to the branch conduction for lowering the temperature on the part of that temperature detection element is effected (S2909). A determination is made whether or not the temperature of that portion is lowered (S2910). If the temperature is lowered, a determination is made whether or not the temperature is too low (S2911). If the temperature is lowered, the switching to the branch conduction corresponding to the original copy paper size is effected (S2916). Then, the operation jumps to a step before step S2905 to repeat the above control.

At step S2910, if the temperature of target temperature detection element is lowered, the conduction to the heater is turned off, and an abnormal indication is made on an indicator 59 (see FIG. 2)(S2914).

EXAMPLE 5

As described in the example 1, the power control for the heater can be effected in accordance with the algorithm relating to the expressions (1) to (9). Accordingly, if it is found how much electric power is to be applied presently, the electric power can be supplied by the above algorithm.

Next, a method for obtaining the electric power value of the heater in this example will be described.

Supposing that the set temperature of heater is $T_o$, the current heater temperature is T, the variation in heater temperature per unit time is ΔT, and the variation in supply electric power is ΔW, the following fuzzy rules are set up:

$R^1$: $(T-T_0)$=NB, ΔT=ZR→ΔW=PB $R^2$: $(T-T_0)$=NM, ΔT=ZR→ΔW=PM $R^3$: $(T-T_0)$=NS, ΔT=ZR→ΔW=PS $R^4$: $(T-T_0)$=PS, ΔT=ZR→ΔW=NS $R^5$: $(T-T_0)$=PM, $\Delta T$=ZR→$\Delta W$=NM $R^6$: $(T-T_0)$=PB, $\Delta T$=ZR→$\Delta W$=NB The above expressions are the fuzzy rules regarding to the extent of changing the applied electric power, depending on the offset amount of the current heater temperature from the target temperature, when the temperature variation is substantially zero.

Also, the expressions:

$R^7$: $(T-T_0)$=ZR, $\Delta T$=NB→$\Delta W$=PB $R^8$: $(T-T^0)$=ZR, $\Delta T$=NM→$\Delta W$=PM $R^9$: $(T-T_0)$=ZR, $\Delta T$=NS→$\Delta W$=PS $R^A$: $(T-T_0)$=ZR, $\Delta T$=PS→$\Delta W$=NS $R^B$: $(T-T_0)$=ZR, $\Delta T$=PM→$\Delta W$=NM $R^C$: $(T-T_0)$=ZR, $\Delta T$=PB→$\Delta W$=NB are the fuzzy rules regarding to the extent of changing the applied electric power, depending on the temperature variation per unit time, when the current heater temperature is substantially equal to the target temperature.

Figures 1, 28A:
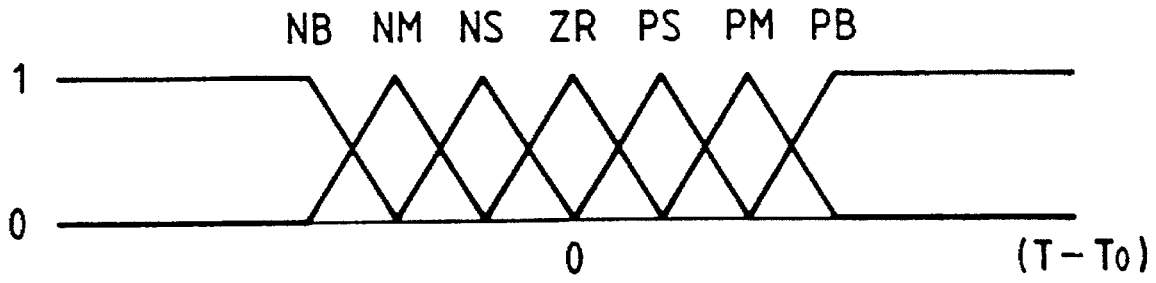
Figures 2, 28A:
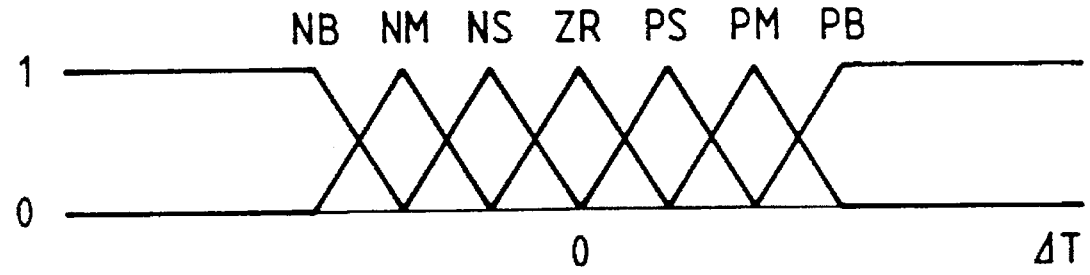
Figures 3, 28A:
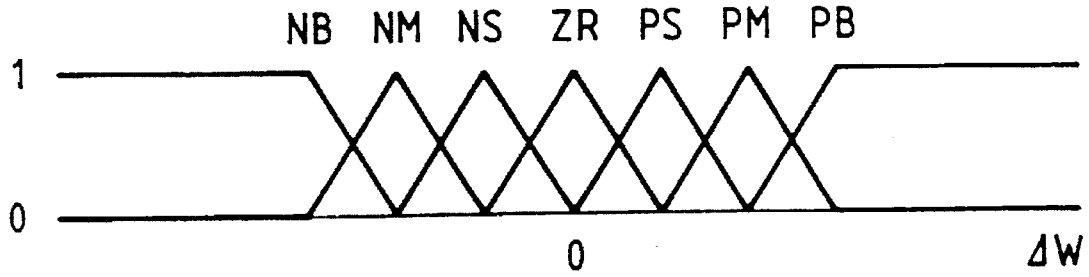
Figures 1, 2, 3, 4, 5, 6, 7, 28B:
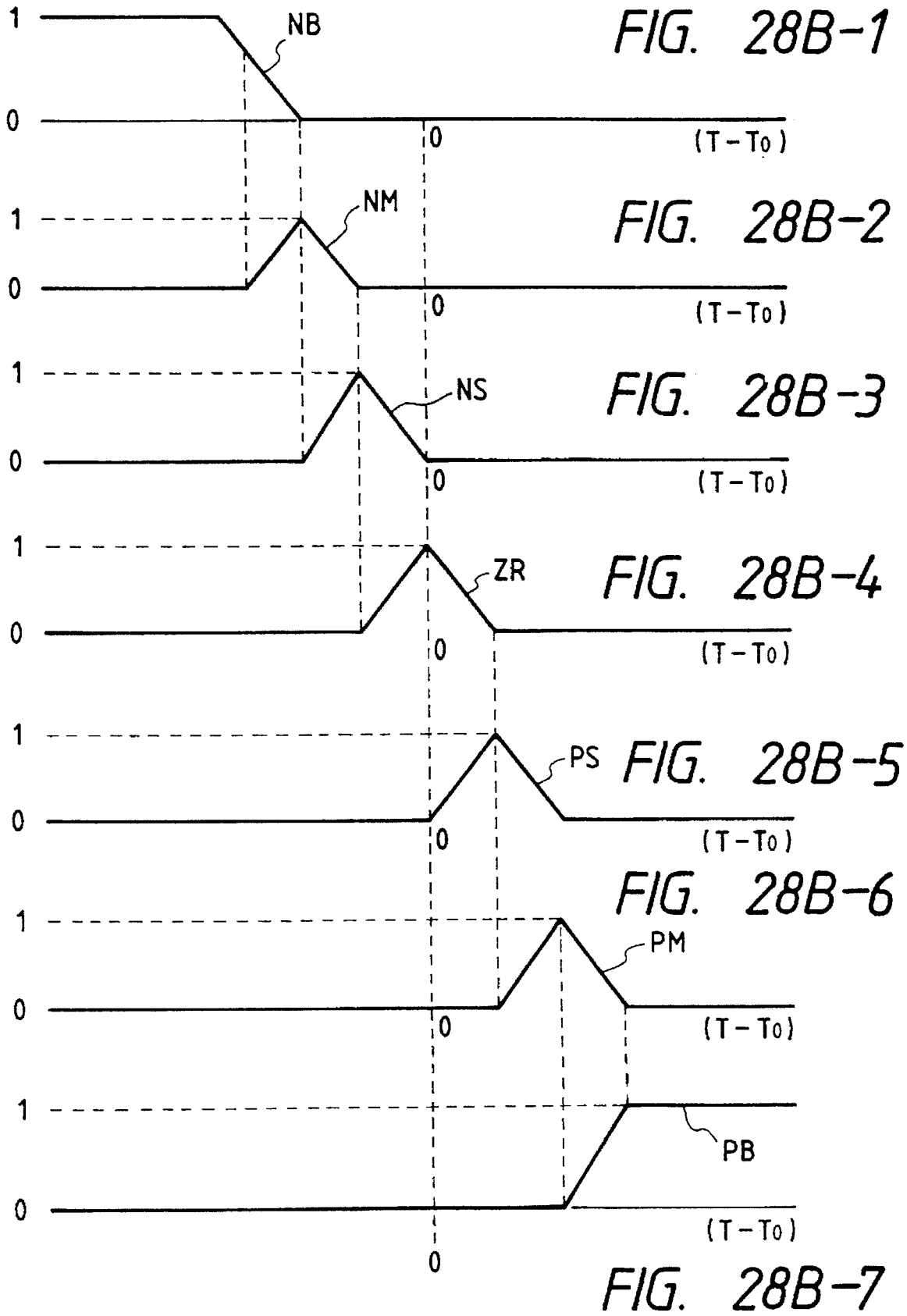

Further, when the current heater temperature is substantially equal to the target temperature, and there is little variation in temperature per unit time, a fuzzy rule:

$R^D$: $(T-T_0)$=ZR, $\Delta T$=ZR→$\Delta W$=ZR is applicable. The examples of these membership functions are shown in FIGS. 28A-1 to 28B-7, and the fuzzy rules are shown in FIG. 29. For example, other rules can be set as shown in FIG. 29. Note that FIGS. 28A-1 to 28A-3 show the superposed state where the views of NB, PB and so on are superposed (see the instances of $(T-T_0)$ in FIGS. 28B-1 to 28B-7).

These rules and membership functions can be changed to have higher precision heater control through the repetitive experimentations.

Figure 30A:
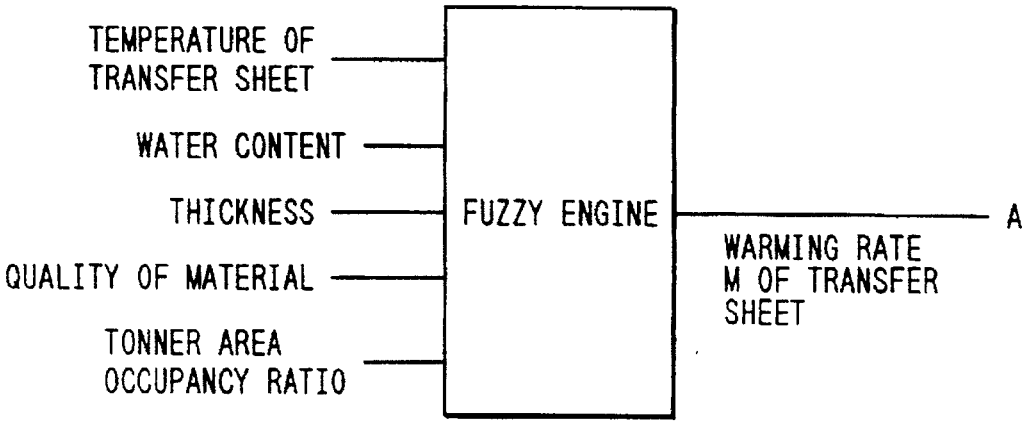
FIG. 30A to 30C is an explanation view showing the control incorporating the warming rate of transfer sheet in the example 5.
Figure 30B:
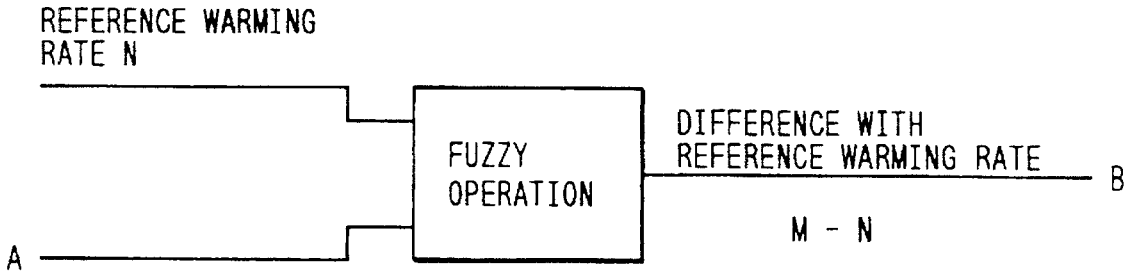
Figure 30C:
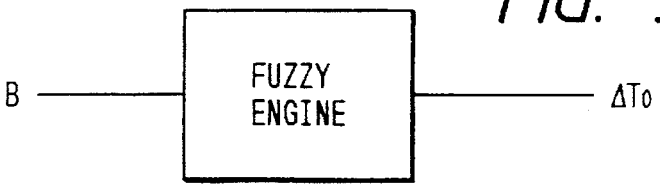

Besides, a more suitable heater control can be effected by incorporating various factors into the heater control. As one example, the control incorporating the warming rate of transfer sheet will be described in FIGS. 30A to 30C.

The warming rate of transfer sheet is a fuzzy definition, but can be determined in the form of a fuzzy number, using the fuzzy rule mainly by the temperature of transfer sheet, water content, quality of material, and toner area occupancy ratio on the transfer sheet. This number is denoted as M.

Then, the warming rate of the normal wood free paper or the regenerated paper is stored as the fuzzy number. This number is denoted as N.

The set temperature is displaced by $\Delta T_0$ from the reference by the fuzzy inference based on the fuzzy number (M−N) produced by taking a subtraction between the above two fuzzy numbers through the fuzzy operation.

Figure 31:
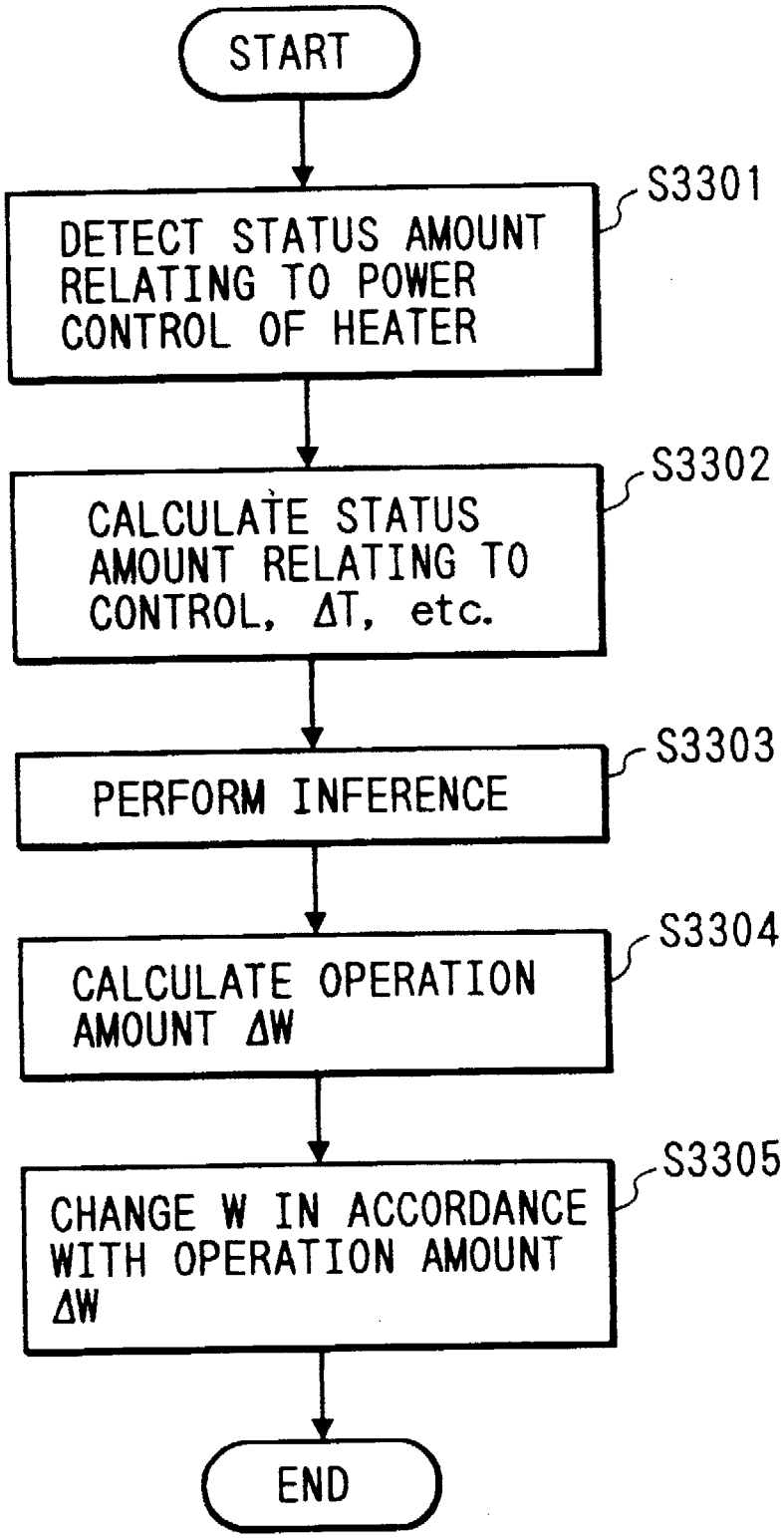
FIG. 31 is a flowchart showing a control procedure of the example 5.

Referring now to FIG. 31, a method for obtaining W will be described again.

First, the status amount relating to the power control of heater is detected (S3301). Then, the status amount relating to the control such as $\Delta T$ is calculated (S3302). And the inference is executed (S3303). Then, the operation amount $\Delta W$ is calculated (S3304), and W is changed in accordance with the operation amount $\Delta W$ (S3305).

EXAMPLE 6

This example takes into consideration the temperature of pressure roller, in addition to the heater temperature as shown in the example 5. This is due to the fact that where there is too great difference in temperature between the pressure roller and the heater, the transfer sheet undergoing fixing may curl up. That is, this is likely to occur at the first copy, especially when the heater temperature is sufficiently low.

In the light of the above, the following fuzzy rules are set up.

$R^{21}$: The temperature of pressure roller when the copy is started is very low. → The set temperature is significantly elevated.

$R^{22}$: The temperature difference between the pressure roller and the heater is very great when the paper passes through the fixing unit. → The heater temperature is made to be closer to the temperature of pressure roller.

$R^{23}$: The fixing ability becomes poor by the temperature obtained as a result of the inference of $R^{22}$. → The set temperature is corrected so that the fixing ability may not be degraded.

Herein, $R^{21}$ is based on the necessity of elevating the temperature of pressure roller as high as possible by applying sufficient quantity of heat to the pressure roller in such a way as to set the heater temperature at a higher value when the temperature of pressure roller is low.

Also, $R^{22}$ is a fuzzy rule performed in passing the paper, wherein the temperature difference between the pressure roller and the heater is sensed, and when that difference is very large, the heater temperature is made to be closer to that of pressure roller to prevent the transfer sheet from curling up.

However, only with the rule of $R^{22}$, there is a risk that the temperature will decrease so that the fixing ability becomes poor. Hence, the correction is made by $R^{23}$, in which the fixing ability is affected by the temperature of pressure roller, the warming rate of transfer sheet as described in the example 5, the outer air temperature, and the humidity.

These factors are introduced, the temperature needed by the heater is obtained through the fuzzy inference, and if that temperature is greater than the temperature obtained through the inference of $R^{22}$, the correction is made, wherein the fixing ability is given priority even though the transfer sheet curls up to some extent. In this case, a warning about the curling can be issued as necessary, and an anti-curl mechanism in the paper exhausting portion can be activated.

It should be noted that the fixing unit as shown in FIGS. 5A to 5C and 6 is presently made of a material such as ceramic which is very fragile to the heat. To afford the durability and not to lose the fixing ability, using such a heater, the application power control, necessary and sufficient, must be performed.

In this way, by making the control, taking into consideration the temperature of fixing unit or heater as well as other factors involved in the fixing ability, the improvement in the fixing ability especially at the first copy can be effected.

Also, the fixing unit as described in this example has enhanced performance and bears a role for establishing the technology as the fixing unit. And this superior technology, which allows for the conduction only when necessary to fulfill the function as the fixing unit, permits the fulfillment of the function as the fixing unit for the faster image forming apparatus.

Further, presently using an image forming apparatus in which such a fixing unit is employed, a simpler structure can be made.

With the present invention, the switching of conduction at the heater branch end is configured to be made when in the nonconduction state, whereby the electric noise at the contact portion can be reduced, so that an image forming operation can be made without having any adverse effect on the heater or other circuits.

With the present invention, the conduction to the fixing heater is turned off or controlled at low temperature during the time other than when the paper is in contact with the fixing heater (heating body), whereby there is obtained the effect that the slippage of the endless film in the continuous copying can be reduced.

With the present invention, the fixing ability can be stabilized despite the dispersion in the temperature distribution of a heat generating resistor. Also, the film slippage control can be performed stably.

With the present invention, when the relation between all the parameters and the control amount is difficult to formulate in the power control for the heater, or when the relation between the parameters and the control amount is ambiguous, because of a great number of parameters (status amounts), these ambiguous relations are subjected to the fuzzy inference to be able to determine the control amount, whereby the improvement in the fixing ability, especially at the first copying, can be effected by making the control in consideration of the heater temperature as well as other factors involved in the fixing ability.

Also, with the present invention, the conduction can be effected only when necessary in fulfilling the function as the fixing unit, whereby the fixing unit for the faster image forming apparatus can be realized.

The present invention is not limited to the above examples, but various variations can be made within the scope of the appended claims. In particular, the above examples can be effected in any suitable combination.

What is claimed is:

1. An image forming apparatus comprising:

heating means having a heat generating resistor having a plurality of branches;

conduction switching means for switching conduction at a branch end of said heat generating resistor;

control means for controlling voltage across said heat generating resistor;

a plurality of temperature detecting means for detecting temperature of said heat generating resistor; and sensing means for sensing a used paper size, wherein the conduction to said branch end is effected in accordance with the paper size sensed by said sensing means, and temperature control of said heat generating resistor is made by temperature detecting means indicating the lowest value among said temperature detecting means in the passing paper portion.

2. An image forming apparatus according to claim 1, wherein the conduction switching operation is repeated until the end of copying, the switching operation including switching to the branch conduction for lowering the temperature of a portion of said temperature detecting means and the temperature of the non-passing paper portion, when there is temperature detecting means indicating a specified temperature or above among said plurality of temperature detecting means in the passing paper portion, and conversely, switching to the branch conduction based on the original paper size when the temperature of said portion of said temperature detecting means is not more than a predetermined specified value.

3. An image forming apparatus according to claim 1, wherein when there is temperature detecting means indicating a specified temperature or above among said plurality of temperature detecting means in the passing paper portion, the switching to the branch conduction for lowering the temperature of a portion of said temperature detecting means and the temperature of the non-passing paper portion is effected, irrespective of the used paper size.

4. An image forming apparatus according to claim 3, wherein when the temperature of said portion is not more than a specified value despite the switching to the branch conduction, the conduction to said heat generating resistor is stopped.

5. An image forming apparatus comprising:

heating means having a heat generating resistor;

a thin film belt moving along with a recording medium; and a fixing unit for heating a toner image on said recording medium by the heat from said heating means via said thin film belt, wherein said fixing unit comprises:

status amount sensing means for sensing or inputting a status amount relating to control of electric power to be supplied to said heating means;

rule means for regulating relation between said status amount and an operation amount in making control of electric power to said heating means, as a qualitative rule; and inferring means for inferring said operation amount based on degree to which said status amount belongs to a predetermined set in accordance with a rule output from said rule means.

6. An image forming apparatus according to claim 5, wherein said status amount sensing means senses, as the status amount, at least one of the temperature of said heat generating resistor, the temperature of pressure roller, the temperature of a member moving along with said recording medium, the responsibility of sensor, a size of copying paper, a type of copying paper, an input voltage, an outer air temperature, humidity, and service condition of a main body in the past.

7. An image forming apparatus according to claim 5, wherein said operation amount is at least one of an electric power adjusting signal for said heat generating resistor, the variation ratio of the electric power adjusting signal for said heat generating resistor, and the corrected value of the electric power adjusting signal.

8. An image forming apparatus according to claim 7, further comprising:

status amount calculating means for calculating a new status amount from said status amount; and membership function storing means for storing a membership function representing said status amount and said operation amount in fuzzy sets, respectively, wherein said rule means has rule storing means for storing the rule representing said status amount and said operation amount in the form of fuzzy proposition, wherein said inferring means comprises:

adaptation calculating means for calculating adaptation of status amount sensed by said status amount sensing means, based on the membership function of status amount stored in said membership function storing means;

arithmetic operation means for obtaining an inferred result of each rule stored in said rule storing means, through a predetermined arithmetic operation, based on the adaptation calculated by said adaptation calculating means; and calculating means for calculating the operation amount based on the inferred result of each rule obtained by said arithmetic operation means.

9. An image forming apparatus comprising:

fixing means for fixing an unfixed image, said fixing means including a heat generating resistor having a plurality of branches:

selecting means for selecting at least one branch of said heat generating resistor;

power supply means for supplying power to the heat generating resistor to the selected branch; and control means for controlling the power to the selected branch of the heat generating resistor, the control including a conductive period and a non-conductive period, and said control means intermittently conducting power supply to the selected branch of said heat generating resistor during the conductive period so that said fixing means reaches a desired temperature, wherein said selecting means comprises means for delaying a selecting operation until a non-conductive period when a change request of selection of a branch of said heat generating resistor is received during a conductive period.

10. An image forming apparatus according to claim 9, further comprising means for sensing a paper size and means for issuing a selection request of a branch of said heat generating resistor to said selecting means based on the paper size sensed.

11. An image forming apparatus according to claim 9, wherein said image forming apparatus is a copying apparatus.

12. An image forming apparatus according to claim 11, wherein said control means starts control in response to a start of a copying operation.

13. An image forming heating apparatus according to claim 9, wherein said fixing means has a heat resistive film moving with a transfer medium between said heat generating resistor and the transfer medium and means for pressing the transfer medium towards said heat generating resistor.

14. An image forming apparatus according to claim 9, wherein said control means controls in accordance with whether a transfer medium is passing through said fixing means.

15. An image forming apparatus according to claim 14, further comprising means for sensing an environmental condition, wherein said control means makes the controls based on the environmental condition sensed when the transfer medium is not passing through said fixing means.

16. An image forming apparatus according to claim 14, further comprising:

exposure means for exposing and scanning an original;

image leading signal generating means for generating an image leading signal along with the scanning of said exposure means; and deciding means for deciding a timing at which said transfer medium has passed over said fixing means, based on said image leading signal.

17. An image forming apparatus according to claim 14, further comprising:

first transfer medium detecting means for detecting a presence of a transfer medium at an entrance of said fixing means in a transfer medium passage;

second transfer medium detecting means for detecting a presence of said transfer medium at an exit of the fixing means in the transfer medium passage; and deciding means for deciding a timing at which said transfer medium has passed over said fixing means, based on the detected results by said first and said second transfer medium detecting means.

18. An image forming apparatus according to claim 9, further comprising a plurality of temperature detecting means for detecting a temperature in proximity to said heat generating resistor, wherein said control means makes the control so that lowest one of temperatures detected by the temperature detecting means corresponding to the selected branch reaches a predetermined temperature.

19. An image forming apparatus according to claim 18, further comprising means for issuing a change request to said selecting means to change selection of the branch of said heat generating resistor when there is a detected temperature which reaches another predetermined temperature, among the detected temperatures of the temperature detecting means corresponding to the selected branch.

20. An image forming apparatus according to claim 19, further comprising means for issuing a change request to said selecting means to change selection of the branch of said heat generating resistor when the detected temperature of the temperature detecting means in which the detected temperature reaches said another predetermined temperature is lowered by the change of the selection at said selecting means.

21. An image forming apparatus according to claim 19, further comprising means for stopping conduction to said heat generating resistor when said detected temperature of the temperature detecting means in which the detected temperature reaches said another predetermined temperature is not lowered even though selection of the branch is changed by said selecting means.

22. An image forming apparatus according to claim 9, wherein said control means comprises:

status amount sensing means for sensing or inputting a status amount relating to control of power supply to said heat generating resistor;

rule means for regulating a relation between said status amount and an operation amount in making the control of the power supply to said heat generating resistor, as a qualitative rule; and inferring means for inferring said operation amount based on a degree to which said status amount belongs to a predetermined set in accordance with a rule output from said rule means.

23. An image forming apparatus according to claim 22, wherein said status amount sensing means senses for a status amount at least one of a temperature in a proximity of said heat generating resistor, a size of copying paper, a type of copying paper, an input voltage, an outer air temperature, a humidity and a post service condition of said apparatus.

24. An image forming apparatus according to claim 22, wherein said operation amount is at least one of a power supply adjusting signal for said heat generating resistor, a variation ratio of the electric power adjusting signal for said heat generating resistor, and a corrected value of the electric power adjusting signal.

25. An image forming apparatus according to claim 22, further comprising:

status amount calculating means for calculating a new status amount from said status amount;

membership function storing means for storing a membership function representing said status amount and said operation amount in a fuzzy set, respectively, wherein said rule means has rule storing means for storing a rule representing said status amount and said operation amount in the form of fuzzy proposition, and wherein said inferring means comprises:

adaptation calculating means for calculating adaptation of a status amount sensed by said status amount sensing means, based on a membership function of status amount stored in said membership function storing means;

arithmetic operation means for obtaining an inferred result of each rule stored in said rule storing means, through a predetermined arithmetic operation, based on the adaptation calculated by said adaptation calculating means; and calculating means for calculating an operation amount based on the inferred result of each rule obtained by said arithmetic operation means.

26. An image forming apparatus according to claim 9, wherein said control means controls conduction of the power supply to the selected heat generating resistor under control of conduction angle.

27. An image forming apparatus comprising:

fixing means for fixing an unfixed image, said fixing means including a heat generating resistor and a film provided between the heat generating resistor and a transfer medium;

power supply means for supplying power to said fixing means;

control means for controlling the power supply to said heat generating resistor; and detecting means for detecting an environmental condition, wherein said control means controls the power supply to said heat generating resistor based on the environmental condition detected by said detecting means when the transfer medium does not pass through said fixing means.

28. An image forming apparatus according to claim 27, further comprising:

exposure means for exposing and scanning an original;

image leading signal generating means for generating an image leading signal along with the scanning by said exposure means; and deciding means for deciding the timing at which said transfer medium has passed over said fixing means, based on the image leading signal.

29. An image forming apparatus according to claim 27, further comprising:

first transfer medium detecting means for detecting a presence of a transfer medium at an entrance of said fixing means in a transfer medium passage;

second transfer medium detecting means for detecting a presence of said transfer medium at an exit of the fixing means in the transfer medium passage; and deciding means for deciding a timing at which said transfer medium has passed over said fixing means, based on the detected results by said first and said second transfer medium detecting means.

* * * * *

UNITED STATES PATENT AND TRADEMARK OFFICE

CERTIFICATE OF CORRECTION

PATENT NO. : 5,640,231
DATED : June 17, 1997
INVENTOR(S) : Teruo MITSUI, et al.

It is certified that error appears in the above-identified patent and that said Letters Patent is hereby corrected as shown below:

COLUMN 5

Line 27, delete "18C-Z" and insert therefor --18C-2--;
Line 52, delete "and" and insert therefor --to--; and
Line 57, delete "FIG." and insert therefor --FIGS.-- and delete "is" and insert therefor --are--.

COLUMN 13, line 67, delete "0n" and insert therefor --On--.

COLUMN 14, line 59, delete "$At_2$" and insert therefor --$\Delta t_2$--.

COLUMN 16

Line 31, delete "18C-2" and insert therefor --18C-1--;
Line 39, delete "FIG." and insert therefor --FIGS.--.

COLUMN 17, line 13, delete "FIG." and insert therefor --FIGS.-- and delete "chart" and insert therefor --charts--.

COLUMN 23, line 28, delete "heating".

Signed and Sealed this

Sixteenth Day of December, 1997

Bruce Lehman

*Attest:*

BRUCE LEHMAN

*Attesting Officer*

*Commissioner of Patents and Trademarks*